US012753463B2

(12) United States Patent
Zhang et al.

(10) Patent No.: US 12,753,463 B2
(45) Date of Patent: Oct. 6, 2026

(54) GAS-ASSISTED MICROFLOW EXTRACTION (GAME) SYSTEM PATENT

(71) Applicants: Virginia Tech Intellectual Properties, Inc., Blacksburg, VA (US); Phinix, LLC, Clayton, MO (US)

(72) Inventors: Wencai Zhang, Blacksburg, VA (US); Subodh Das, Clayton, MO (US)

(73) Assignees: Virginia Tech Intellectual Property, Inc., Blacksburg, VA (US); Virginia Polytechnic Institute and State University, Blacksburg, VA (US); Phinix, LLC, Clayton, MI (US)

( * ) Notice: Subject to any disclaimer, the term of this patent is extended or adjusted under 35 U.S.C. 154(b) by 481 days.

(21) Appl. No.: 18/340,248

(22) Filed: Jun. 23, 2023

(65) Prior Publication Data

US 2023/0416867 A1 Dec. 28, 2023

Related U.S. Application Data

(60) Provisional application No. 63/354,888, filed on Jun. 23, 2022.

(51) Int. Cl.
*C22B 3/26* (2006.01)
*C22B 3/02* (2006.01)
(Continued)

(52) U.S. Cl.
CPC ..... *C22B 3/26* (2021.05); *C22B 3/02* (2013.01); *C22B 3/10* (2013.01); *C22B 3/14* (2013.01);
(Continued)

(58) Field of Classification Search
CPC . B01D 11/04; B01D 11/0415; B01D 11/0426; B01D 11/043; C22B 3/26;
(Continued)

(56) References Cited

U.S. PATENT DOCUMENTS 3,018,253 A 1/1962 Grinstead
4,278,640 A 7/1981 Allen et al.
7,291,202 B2 11/2007 Asano et al.

FOREIGN PATENT DOCUMENTS

CN 102284190 B 8/2013
CN 112538570 A * 3/2021 ..... B03D 1/02
(Continued)

OTHER PUBLICATIONS

Machine-generated translation of CN 102284190 (A) (Applicants: Inst Process Eng Cas; Inventors: Liu Huizhou, Yu Pinhua, Zhao Junmei, Huang Kun), published originally on Dec. 21, 2011. (Year: 2011).*

(Continued)

*Primary Examiner* — Vanessa T. Luk
(74) *Attorney, Agent, or Firm* — Dinsmore & Shohl LLP

(57) ABSTRACT

The present disclosure concerns a Gas-Assisted Microbubble Extraction (GAME) system with an innovative dispersion module that can be used to efficiently separate and purify base metals and rare earth elements from various sources. The GAME system utilizes a three phase system of a gas phase, an organic phase, and an aqueous phase to efficiently extract low concentration metals from a solution.

17 Claims, 18 Drawing Sheets

(51) Int. Cl.

| | |
|---|---|
| ***C22B 3/10*** | (2006.01) |
| ***C22B 3/14*** | (2006.01) |
| ***C22B 3/38*** | (2006.01) |
| ***C22B 7/00*** | (2006.01) |
| ***C22B 11/00*** | (2006.01) |

(52) U.S. Cl.
CPC ..... *C22B 3/3846* (2021.05); *C22B 7/007* (2013.01); *C22B 7/008* (2013.01); *C22B 11/046* (2013.01)

(58) Field of Classification Search
CPC .... C22B 3/33; C22B 3/28; C22B 3/30; C22B 3/32; C22B 3/34; C22B 3/37; C22B 3/41; C22B 3/36; C22B 3/38; C22B 3/40
See application file for complete search history.

(56) References Cited

FOREIGN PATENT DOCUMENTS

| | | | |
|---|---|---|---|
| GB | 2248789 | A | 4/1992 |
| JP | 2003105456 | A | 9/2003 |
| WO | 2018217083 | A1 | 11/2018 |

OTHER PUBLICATIONS

International Search Report for PCT Application No. US2023/026069, (Mail Date: Oct. 13, 2023).

* cited by examiner

GAS-ASSISTED MICROFLOW EXTRACTION (GAME) SYSTEM PATENT

CROSS-REFERENCE TO RELATED APPLICATIONS

This application claims priority to U.S. Provisional Patent Application 63/354,888 filed on Jun. 23, 2022, all of which are hereby incorporated by reference in their entirety.

GOVERNMENT SUPPORT

This invention was made with Government support under grants DE-EE0007897 and DE-EE0009435 awarded by the Department of Energy. The Government has certain rights in the invention.

FIELD OF THE INVENTION

This document relates generally to the field of metal recovery, more particularly, to the recovery of low-concentration valuable metals from complex aqueous streams. In addition, this document also relates to the recycling of electronic waste through hydrometallurgical approaches.

BACKGROUND

All existing metal recovery methods, such as solvent extraction, ion-exchange, selective adsorption, precipitation, and membrane technologies, have a lower limit on the concentration of target species in aqueous solution. At present there are no economically viable methods that can extract metal ions of exceedingly low concentrations from complex aqueous streams. Solvent extraction is one of the most widely used metal extraction technologies due to its low operating cost and high throughput capacity. However, to extraction low-concentration metal ions, a large volumetric ratio of aqueous to organic phase (A/O) is required to ensure that the organic phase becomes saturated within a reasonable timeframe and the operating costs are acceptable. However, conventional mixer-settlers cannot handle exceedingly large A/O ratios (e.g., 100) due to the low extraction kinetics and the inefficient dispersion of the organic phase by mechanical stirring.

Printed circuit boards (PCBs) are an essential component of modern electronic equipment and are one of the most promising e-waste sources of precious metals. For example, typical PC motherboards contain 566 ppm gold, 639 ppm silver, and 124 ppm palladium—two of which (gold and palladium) are more than an order of magnitude above typical economic ore grades. However, regardless of this fact, the content of precious metals in waste PCBs (WPCBs) is still much lower than the content of base metals (ppm versus % levels). E-waste recycling through pyrometallurgical approaches is energy intensive and does not align with carbon neutrality. Compared with pyrometallurgical approaches, hydrometallurgical approaches are more environmentally friendly since no high temperatures are used. However, solutions containing low concentrations of precious metals and complex matrices are generated from hydrometallurgical processes. Similarly, rare earth elements (REEs) are present in many natural materials, yet are in such low abundance that their recovery and concentration therefrom is difficult. Efficient separation and concentration of precious metals from the solutions remain a need to be addressed.

SUMMARY

Bulk solvent extraction (BSE) with conventional mixer-settlers is one of the most common techniques used in extractive metallurgy to separate valuable metals from mineral leach solutions; however, the disadvantages of this method become increasingly apparent when the concentration of target metals in the leach solutions decreases to low values. These unavoidable issues include long residence time, complex processing circuits, and high extraction cost.

Direct recovery of low-concentration metals using BSE with conventional mixer-settlers is not viable. As in conventional mixer-settlers, long loading times are needed to build up the concentration of valuable metals in the organic phase, particularly when the concentration in the initial leach solution is extremely dilute. In practice, this long loading time can be supplanted by a large aqueous to organic (A/O) phase ratio; however, BSE with conventional mixer-settlers is cost prohibitive and physically non-tenable in practice. A novel reactor based on gas-assisted microbubble extraction (GAME) was designed to overcome the challenges of recovering low-concentration, valuable elements from complex metal-bearing streams. The GAME reactor uses three phases (aqueous, organic, and gas) to achieve an efficient extraction of low-concentration species.

A good application of the GAME reactor is the recovery of valuable metals from WPCBs which contains a decent amount of precious metals, but the content is still several orders of magnitude lower than that of base metals. As a result, leach solutions with much lower concentrations of precious metals than base metals are normally obtained when using hydrometallurgical approaches. In this case, the precious metal can be efficiently extracted using the GAME reactor with appropriate reagents under certain conditions. Besides the GAME reactor, a process based on two-stage leaching was developed to achieve a certain degree of separation between base and precious metals prior to solvent extraction. In the two-stage leaching step, different lixiviants are used to achieve selective dissolution.

The technologies disclosed herein will contribute to the recovery of low-concentration valuable species from aqueous streams and the recycling of electronic waste. The valuable species include but are not limited to energy-relevant elements (e.g., lithium, nickel, cobalt, manganese), rare earth elements (e.g., neodymium, yttrium, scandium), base metals (e.g., copper, aluminum). The aqueous streams can be naturally formed or generated from the industry and urban.

A 1$^{st}$ aspect of the present disclosure, either alone or in combination with any other aspect herein, concerns a process for extracting a low-concentration metal comprising: providing a metal solution to a three segment vertical reactor comprising a bottom segment for gas, a middle segment for an organic phase feed and an upper segment for an aqueous phase feed and an upper exit port, wherein the organic phase comprises one or more organic extractants and the aqueous phase comprises the metal solution and wherein a first porous material separates the bottom segment and the middle segment and a second porous material separates the middle segment and the upper segment; introducing a gas to the reactor in the bottom segment, wherein the first porous material causes the gas to form bubbles in the organic phase and further wherein gas bubbles, organic droplets and organic phase-coated bubbles enter the aqueous phase to absorb one or more metals therein; collecting a mixed phase from the upper exit port comprised of the gas, organic phase and aqueous phase; separating the mixed phase into an organic fraction and an aqueous fraction; and, isolating one or more metals from the organic fraction. The metal of the metal solution may include a precious metal, such as gold, silver, platinum, palladium, ruthenium, rhodium, iridium, and osmium. The metal of the metal solution may include a rare earth element, such as yttrium, scandium, lanthanum, cerium, praseodymium, neodymium, promethium, samarium, europium, gadolinium, terbium, dysprosium, holmium, erbium, thulium, ytterbium, and lutetium. The metal of the metal solution may include a base metal, such as copper, nickel, tin, aluminum, zinc, tin, lead, iron, and titanium. The metal of the metal solution may include a radioactive metal, such as uranium, thorium, polonium, radium, and neptunium. The metal of the metal solution may include an energy-relevant metal, such as lithium, nickel, cobalt, manganese, magnesium, vanadium, and chromium.

A $2^{nd}$ aspect of the present disclosure, either alone or in combination with any other aspect herein, concerns the process of the $1^{st}$ aspect, wherein the aqueous phase to organic phase volumetric ratio therein is at least 20.

A $3^{rd}$ aspect of the present disclosure, either alone or in combination with any other aspect herein, concerns the process of the $1^{st}$ aspect, wherein the gas is selected from compressed air, carbon dioxide, nitrogen, oxygen, argon, helium, neon, krypton, and xenon.

A $4^{th}$ aspect of the present disclosure, either alone or in combination with any other aspect herein, concerns the process of the $1^{st}$ aspect, wherein the first porous material and the second porous material both comprise pores of 1 to 100 μm.

A $5^{th}$ aspect of the present disclosure, either alone or in combination with any other aspect herein, concerns the process of the $1^{st}$ aspect, wherein the first porous material and the second porous material are independently selected from a ultra high molecular weight polyethylene (UHMWPE), high density polyethylene (HDPE), polypropylene (PP), polytetrafluoroethylene (PTFE), polyvinylidene fluoride (PVDF), ethylene vinyl acetate (EVA), polyether sulfone (PES), polyurethane (PU), a metal, a metal oxide, stainless steel, copper, aluminum, zirconiva, silica, quarts, a ceramic, or glass.

A $6^{th}$ aspect of the present disclosure, either alone or in combination with any other aspect herein, concerns the process of the $1^{st}$ aspect, wherein the organic extractant is selected from a neutral extractant compound with a compounds with a C—O, P—O, S—O, and/or P—S bond, an acidic extractant compound that contains a —COOH, —P(O)OH, and/or —$SO_3H$ group, and an alkaline extractant compound that contains an amine or quaternary ammonium group.

A $7^{th}$ aspect of the present disclosure, either alone or in combination with any other aspect herein, concerns the process of the $6^{th}$ aspect, wherein the organic extractant comprises Di(2-ethylhexyl)phosphoric acid (D2EHPA).

An $8^{th}$ aspect of the present disclosure, either alone or in combination with any other aspect herein, concerns the process of the $1^{st}$ aspect, further comprising preparing the aqueous phase by contacting a metal source with a leachant and collecting a leached metal solution therefrom as the aqueous phase.

A $9^{th}$ aspect of the present disclosure, either alone or in combination with any other aspect herein, concerns the process of the $8^{th}$ aspect, wherein the leachant is selected from a mineral acid, an inorganic acid, a salt, an oxidizing agent, a reducing agent, a complexing agent, and a base.

A $10^{th}$ aspect of the present disclosure, either alone or in combination with any other aspect herein, concerns the process of the $8^{th}$ aspect, wherein the leachant comprises a complexing agent and an oxidizing agent or thiourea and oxygen.

An $11^{th}$ aspect of the present disclosure, either alone or in combination with any other aspect herein, concerns the process of the $8^{th}$ aspect, further comprising a further leaching stage prior to contact with the lixivant comprising dissolving base metals with a mineral acid or a mineral acid and an oxidizing agent.

A $12^{th}$ aspect of the present disclosure, either alone or in combination with any other aspect herein, concerns the process of the $11^{th}$ aspect, wherein the mineral acid is hydrochloric acid and hydrogen peroxide.

A $13^{th}$ aspect of the present disclosure, either alone or in combination with any other aspect herein, concerns the process of the $11^{th}$ aspect, wherein the solution from the further leaching stage is also fed to the reactor as at least part of the aqueous phase.

A $14^{th}$ aspect of the present disclosure, either alone or in combination with any other aspect herein, concerns the process of the $1^{st}$ aspect, wherein the organic phase and aqueous phase are independently pumped into the reactor at a rate of between 1 mL/min to 100 L/min.

A $15^{th}$ aspect of the present disclosure, either alone or in combination with any other aspect herein, concerns the process of the $1^{st}$ aspect, wherein the gas is introduced at a rate of from 1 mL/min to 100 L/min.

A $16^{th}$ aspect of the present disclosure, either alone or in combination with any other aspect herein, concerns the process of the $1^{st}$ aspect, further comprising combustion of a composition comprising a base metal, a precious metal, and/or a rare earth metal to obtain an ash and contacting the ash with a leachant and then providing the leachant to the reactor as at least part of the aqueous phase.

A $17^{th}$ aspect of the present disclosure, either alone or in combination with any other aspect herein, concerns a reactor for Gas-Assisted Microbubble Extraction (GAME) of a base metal, a precious metal, and/or a rare earth element from an aqueous phase feed, comprising: a three segment vertical reactor comprising a bottom segment for gas, a middle segment for an organic phase feed and an upper segment for an aqueous phase feed, wherein the organic phase comprises one or more organic extractants and the aqueous phase comprises the metal solution; an upper exit port in the upper segment; a first porous material that separates the bottom segment and the middle segment; and, a second porous material that separates the middle segment and the upper segment.

DESCRIPTION

Figure 1:
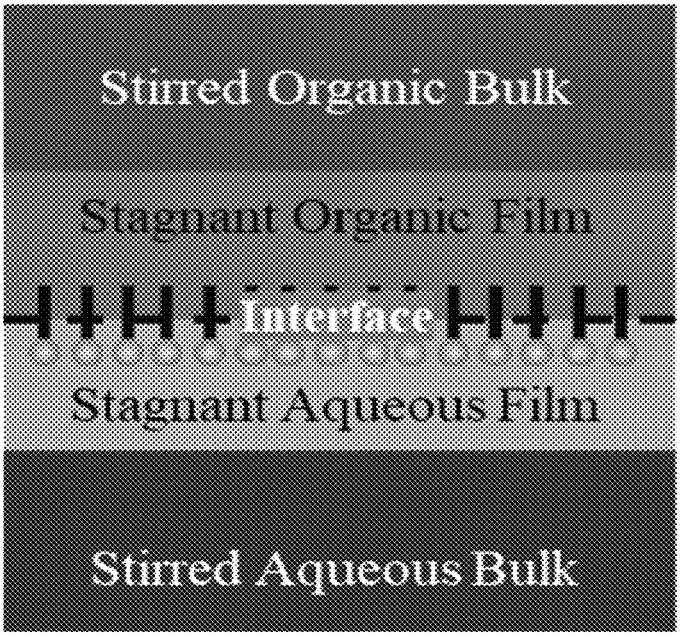
FIG. 1 shows interfacial diffusion films.

The present disclosure concerns gas-assisted microbubble extraction (GAME) with a novel reactor that enables the formation of organic phase-coated air bubbles dispersed in the aqueous phase to extract low concentration metals from a solution thereof. In some aspects, the solution is prepared by a two-stage leaching process that leaches base and precious metals from a source, such as e-waste, in two separate stages. The base metal leach solution is processed using normal methods, such as solvent extraction with bulk mixer-settlers, due to their high concentrations. However, the precious metal solution is processed using GAME that allows the formation of organic phase-coated air bubbles dispersed in the aqueous phase. The surface area of the organic phase is increased, while the mass transfer distance between the aqueous and organic phases is decreased in the GAME reactor. All these factors contribute to its high efficiency in extracting low-concentration precious metals from the leach solution. Importantly, rather than limiting to the leach solution of electronic waste, the GAME reactor can be applied to extract any target species from any aqueous streams if appropriate extractants and extraction conditions are selected.

Electrical and electronic equipment (EEE) is everywhere in our modern life, such as cell phones, computers, refrigerators, air conditioners, and many more. Since the discovery of electricity and its use as a second energy source in our daily lives, various electronic and electrical products have been developed to enhance the comfort and convenience of our lives. Predictably, the demand for electronic products will only increase in the information age. While enjoying the benefits that electronics bring to our lives, we cannot ignore the existence of waste electrical and electronic equipment (WEEE) or e-waste. Due to limited maintenance methods and rapid technological upgrades, many obsolete and end-of-life electronic products that cannot be reused, refurbishment, and remanufactured, become waste and require centralized recycling management and disposal (A Ahirwar, R., & Tripathi, A. K. (2021). *Environmental Nanotechnology, Monitoring & Management,* 15, 100409; He et al., 2006 *J Hazard Mater,* 136(3), 502-512; Montalvo et al., 2016 "A longer lifetime for products: benefits for consumers and companies.").

Printed circuit boards (PCBs) are an important component of EEE, accounting for nearly 6% of the total weight of components removed from the e-waste (Barragan et al., 2020 ACS Omega, 5(21), 12355-12363), but creating approximately 40% of the total value of the e-waste (Golev et al., 2016 *Waste Management,* 58, 348-358). Precious metals comprise the most valuable part of PCBs, which contributes 90% of the value even though it only accounts for 0.01-1% of the total weight (Işildar et al., 2018 *Resources, Conservation and Recycling,* 135, 296-312; Moyo et al., 2020 *Resources, Conservation and Recycling,* 152, 104545). Waste printed circuit boards (WPCBs) are complex materials that may contain up to 63 different elements (Hong et al., 2020 *Proceedings of the National Academy of Sciences,* 117(28), 16174-16180), and can be considered to be composed of 30% polymer, 30% ceramic, and 40% metal, namely 60% non-metallic fractions (NMFs) and 40% metallic fractions (MFs) (Ribeiro et al., 2019 *Journal of Materials Research and Technology,* 8(1), 513-520). Recycling e-waste requires special attention because various metals and organic compounds used as materials can lead to toxic and harmful components released into the surrounding environment during the recycling process, such as size reduction and combustion (Ahirwar & Tripathi, 2021).

Game Reactor and Process

In aspects, the present disclosure concerns a novel reactor and process to extract and/or recover low-concentration metals from a solution. As described herein, there are several additional processing steps that may be utilized to generate or provide the metal solution to the reactor. In some aspects, the reactor includes a containment with an aqueous phase and an organic phase therein. For extracting low-concentration metals, a high aqueous to organic phase volumetric (A/O) ratio has to be used, which allows the organic phase to reach critical saturation values in a shorter time period. In some aspects, acids and other chemicals consumed in the scrubbing and stripping stages as discussed herein The kinetics of solvent extraction is a function of both kinetics of the various chemical reactions that occur in the system and the diffusion rate of the various species that control the chemistry. Mechanical stirring is normally applied in bulk solvent extraction with mixer-settlers to make sure that the aqueous and organic phases are well-mixed. However, as FIG. 1 shows, no matter how strong the stirring, two stagnant thin films always exist at the aqueous-organic interface, which can only be crossed by diffusion processes. The amount of solute passing perpendicularly through a unit area of the films during a unit time can be measured using diffusion flux J(g/cm$^2$/s), which is expressed through Fick's first law:

$$J = -D\frac{\partial C}{\partial h}$$

where C and h represent the bulk concentration of the solute and thickness of the films, respectively, and D is the diffusion coefficient. Extraction kinetics can be improved by multiple means, such as decreasing film thickness and increasing interfacial area. However, the size of the interface area that can be generated through mechanical stirring is limited, since excessive stirring will lead to the formation of emulsions, which are difficult to coalesce, and can cause problems in phase disengagement. Moreover, as in the equation, the diffusion rate will be exceedingly small when the concentration of target metals in aqueous phase is low; thus, solvent extraction with conventional mixer-settlers is not suitable for processing solutions with valuable species of low concentrations can be significantly reduced, thus promoting economic viability for metal recovery from low-concentration leach solutions. Micro-flow extraction (ME) occurs in well-defined channels in the range of a few hundred microns, which brings remarkably high mass transfer rates due to the large interfacial area and short mass transfer diffusion distance. The volumetric mass transfer coefficients of microflow extractors are several orders of magnitude larger than those of the conventional extractors. Therefore, high extraction recoveries can be achieved during a short residence time. Moreover, high volumetric throughputs can be achieved by "numbering-up;" i.e., using numerous reactors in parallel to maintain optimal physical and chemical conditions. A liquid-liquid two-phase microflow is most commonly found in a ME system, which can be easily achieved in micro-structured components, such as microchannels and microtubes.

ME has numerous advantages over bulk solvent extraction with mixer-settlers, such as a high mass transfer rate and low residence time. Benefiting from the enhanced mass transfer caused by chaotic advections, plug flow and bubbly flow extractors can operate properly under relatively high A/O ratios. However, once the structure and dimension of microchannels are fixed, the length between two adjacent plugs increased with the increase in the A/O ratio, which led to a longer mass diffusion distance and lower extraction efficiency (see FIG. 2). This indicates that liquid-liquid two-phase microflow extractors cannot efficiently extract low-concentration metals from aqueous solutions where extremely high A/O ratios must be used. In some aspects, the A/O ratio is of at least 15, at least 20, at least 25, at least 30, at least 35, at least 40, at least 45, or at least 50 or higher.

Figure 3:
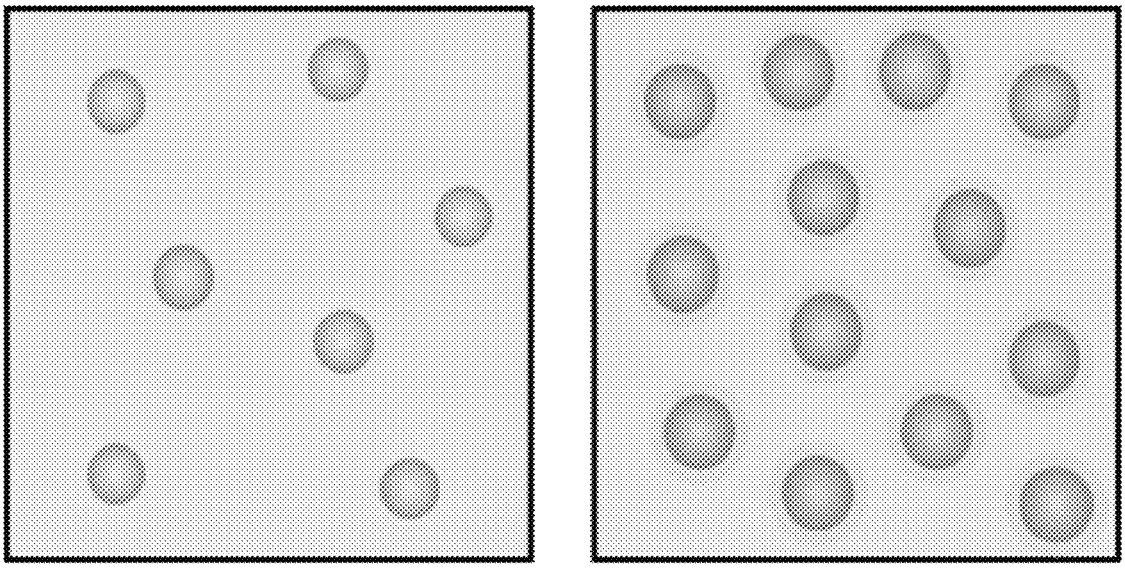
FIG. 3 shows dispersed organic phase in aqueous phase: solid organic droplets (left); hollow organic droplets (right).

In aspects, the present disclosure concerns providing a gas to the containment of the reactor. In aspects, the containment is configured to allow a gas phase to enter, such as with a port. Introducing a third phase (gas) into the system converts the dispersed organic phase from solid into hollow droplets. As FIG. 3 shows, in a confined space, the organic phase is more dispersed when occurring as hollow droplets. Therefore, the mass transfer rate and extraction efficiency are considerably improved. Per this concept, gas-assisted microbubble extraction (GAME) systems can be used to handle extremely high A/O situations. Moreover, the introduction of a third phase increases the degree of mixing, which further improves mass transfer rates. Therefore, efficient separation can be achieved through GAME.

Figure 4:
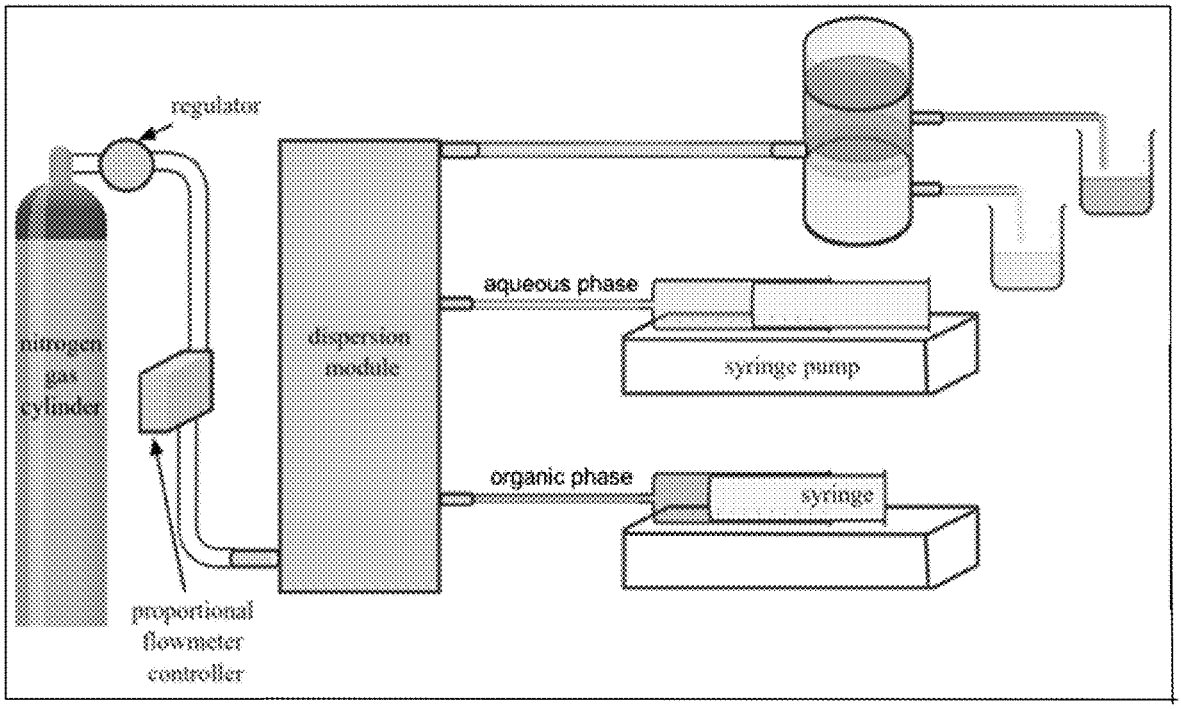
FIG. 4 shows an overview of the GAME system reactor.

GAME can occur in microchannels like ME; however, the throughout capacity is low due to the small diameter of microchannels. A novel reactor that enables GAME at high throughput capacities was designed by the inventors. As FIG. 4 shows, the reactor includes three compartments that are separated by two porous media (e.g., glass frits). A gas phase (e.g., nitrogen) is introduced into the bottom compartment and goes into the second compartment where the organic phase is introduced. When the gas passes the bottom porous media, bubbles are formed in the middle compartment. Under the function of positive pressure, both the organic and gaseous phases go into the top compartment, where the aqueous phase is introduced. Under the function of the top porous media, bubbles coated with the organic phase are formed and finely dispersed in the aqueous phase. Therefore, the mass transfer distance between the aqueous and organic phases is reduced, and the reactor is suitable for handling exceedingly high A/O ratio situations. In other words, solvent extraction with the GAME extractor can extract low-concentration species from complex aqueous streams.

The GAME system includes a dispersion module for the three phases and may further include a gas cylinder, a gas regulator, and a proportional flowmeter controller to supply gas that can be precisely controlled to the required gas flowrate. In some aspects, the gas provided is a non-reactive gas, such as compressed air, carbon dioxide, nitrogen, oxygen, argon, helium, neon, krypton, xenon, or similar. In some aspects, the gas is provided to the dispersion module at a flow rate of from about 1 mL/min to about 100 L/min. In some aspects, the organic phase and the aqueous phase are pumped into the dispersion module independently at a rate of about 1 mL/min to about 100 L/min. For example, as set forth in the examples herein, two glass syringes and two precise syringe pumps were used to input the aqueous phase and organic phase into the dispersion module, respectively.

The aqueous phase of the GAME system includes the metal(s) to be extracted by the system. Any metal can be extracted, including base metals, precious metals, radiopactive metals, energy-relevant metals, and rare earth elements (REEs). For example, as set forth in the examples, an aqueous phase containing REEs was a liquid leachate from an Allanite ore. The metal of the metal solution may include a precious metal, such as gold, silver, platinum, palladium, ruthenium, rhodium, iridium, and osmium. The metal of the metal solution may include a rare earth element, such as yttrium, scandium, lanthanum, cerium, praseodymium, neodymium, promethium, samarium, europium, gadolinium, terbium, dysprosium, holmium, erbium, thulium, ytterbium, and lutetium. The metal of the metal solution may include a base metal, such as copper, nickel, tin, aluminum, zinc, tin, lead, iron, and titanium. The metal of the metal solution may include a radioactive metal, such as uranium, thorium, polonium, radium, and neptunium. The metal of the metal solution may include an energy-relevant metal, such as lithium, nickel, cobalt, manganese, magnesium, vanadium, and chromium.

The organic phase of the GAME system includes extractants/lixiviants effective for the metal(s) being extracted. Extractants/lixiviants may include neutral extractants, such as compounds with a C—O, P—O, S—O, and/or P—S bond, acidic extractants, such as compounds that contain —COOH, —P(O)OH, and/or —$SO_3H$ groups, or alkaline extractants, such as compounds with an amine or quaternary ammonium group. For example, with the Allanite ore, REEs were extracted using Di(2-ethylhexyl)phosphoric acid (D2EHPA) as the extractant/lixiviant.

The gas is created through the porous membrane and flows upwardly in the dispersion module. After the gas passes through the dispersion module, the gas can be collected. Meanwhile, the aqueous raffinate and loaded organic phase (or mixed phase) can also be collected in a separate container for further phase separation. The loaded organic phase concentrated with metal(s), such as base metals, precious metals, and/or REEs can be then further processed by scrubbing, stripping, precipitation, and other downstream processing to produce a purified metal and/or oxide thereof.

Figure 5:
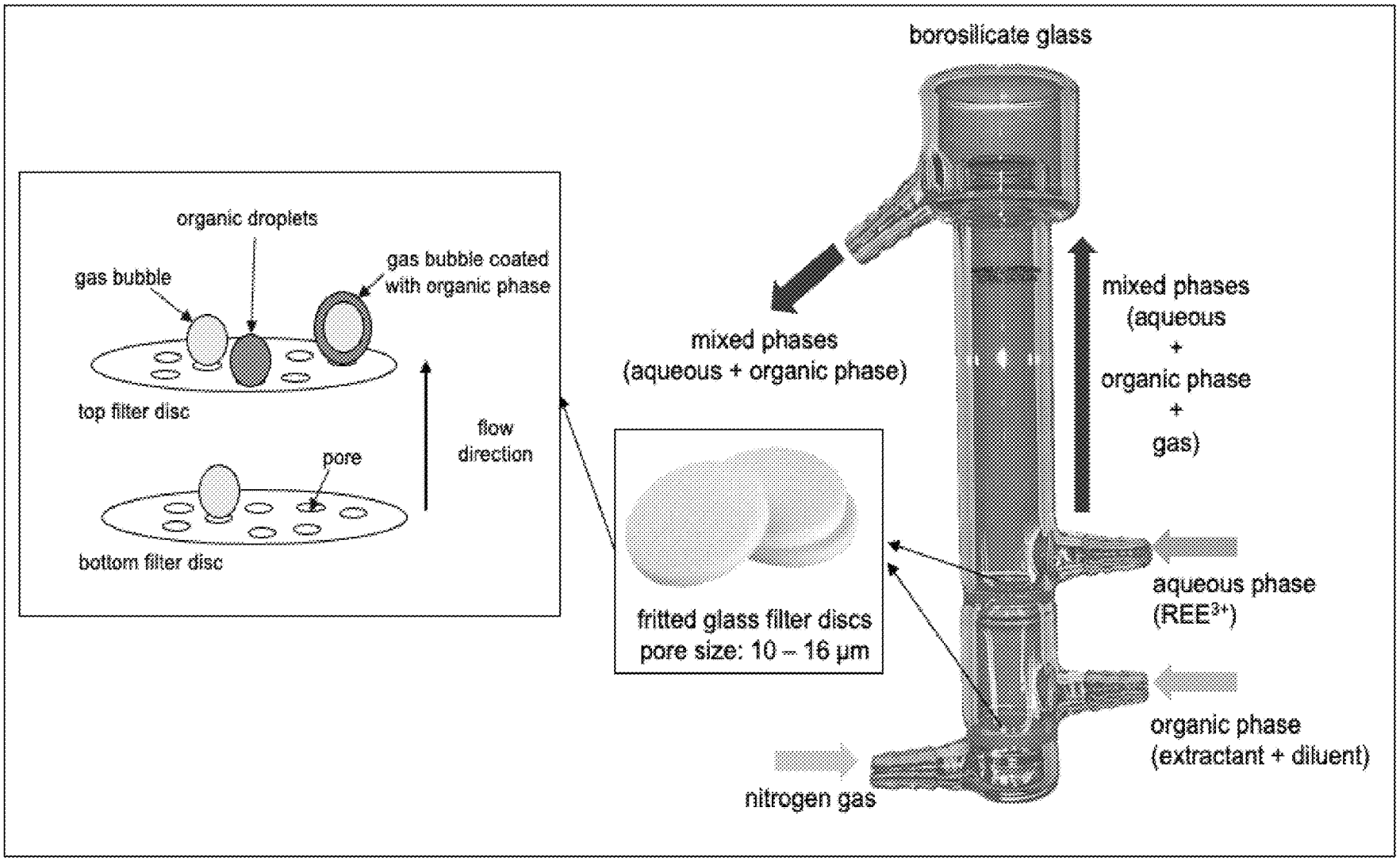
FIG. 5 shows an example of the dispersion module with insets showing the formation of different bubble types formed and examples of the porous separators that assist in their production.

The dispersion module, as shown in FIG. 5, is a significant component of the GAME system. The dispersion module is used to form organic phase-coated nitrogen microbubbles dispersed in the aqueous phase. Therefore, the surface area of the organic phase is significantly increased in the aqueous phase, which benefits the extraction kinetics. The column of the dispersion module need not be of any particular material, so long as it is non-reactive with the components. For example, as set forth in the examples, the dispersion module was made of borosilicate glass.

The dispersion module further includes three inputs for the gas, aqueous, and organic phases, and one output for the mixed phase. Two porous membranes are positioned within the dispersion module beneath the organic and aqueous phase inputs. The porous membranes include pores of about 1 to 100 μm, including about 1, 2, 3, 4, 5, 6, 7, 8, 9, 10, 11, 12, 13, 14, 15, 16, 17, 18, 19, 20, 25, 30, 35, 40, 45, 50, 55, 60, 65, 70, 75, 80, 85, 90, and 95 μm. In some aspects, the porous membrane may be of a non-reactive material such as ultra high molecular weight polyethylene (UHMWPE), high density polyethylene (HDPE), polypropylene (PP), polytetrafluoroethylene (PTFE), polyvinylidene fluoride (PVDF), ethylene vinyl acetate (EVA), polyether sulfone (PES), polyurethane (PU), a metal, a metal oxide, stainless steel, copper, aluminum, zirconiva, silica, quarts, a ceramic, or glass. For example, as set forth in the working examples, two fritted glass filter discs with a pore size of 10 to 16 micrometers were inserted in the column.

Figure 6:
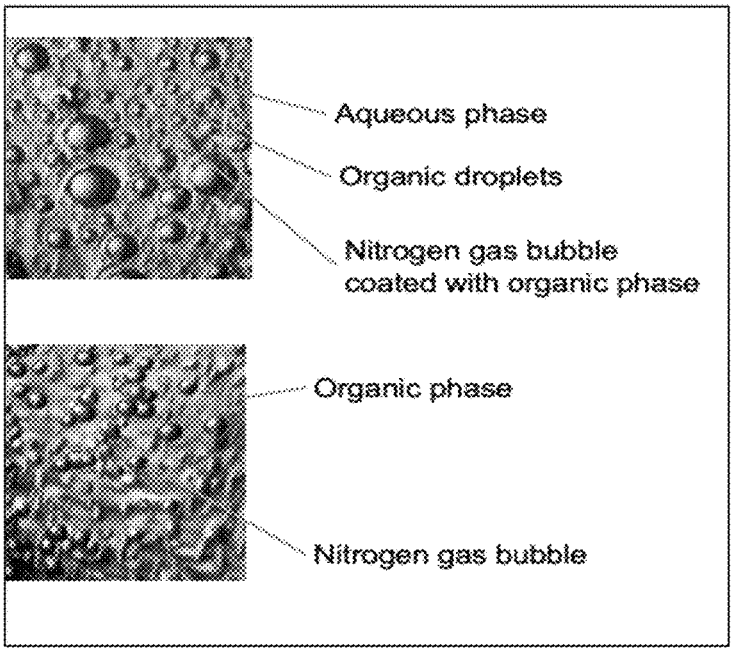
FIG. 6 shows the generation of organic droplets and nitrogen gas bubbles coated with the organic phase.

When the gas flows through the bottom membrane, gas bubbles are generated in the organic phase. When the gas bubbles and the organic phase flowed through the second membrane, three different bubbles are generated in the aqueous phase, which are gas bubbles, organic droplets, and gas bubbles coated with the organic phase. Those bubbles are then dispersed in the aqueous phase to conduct the solvent extraction processing. As shown in FIG. 6, the real gas bubbles, organic droplets, and gas bubbles coated with the organic phase were observed in the dispersion module with a microscope. Those microbubbles were well dispersed in the aqueous phase, where the mixture looked like an emulsion.

In some aspects, the metal or metal(s) extracted by the GAME system are determined by, at least in part, the extractant or lixiviant used in the organic phase and/or the concentration thereof. Extractants/lixiviants may include neutral extractants, such as compounds with a C—O, P—O, S—O, and/or P—S bond, acidic extractants, such as compounds that contain —COOH, —P(O)OH, and/or —$SO_3H$ groups, or alkaline extractants, such as compounds with an amine or quaternary ammonium group. In some aspects, the concentration of the extractant or lixiviant may be varied. In some aspects, the concentration of the lixiviant or extractant might be of about M to about 10 M, including 0.2, 0.3, 0.4, 0.5, 0.6, 0.7, 0.8, 0.9, 1, 2, 3, 4, 5, 6, 7, 8, and 9 M. In some aspects, the flow of the gas/bubbles through the dispersion module can be regulated as well, such as a rate of about 0.001 L/min to about 100 L/min including 0.002, 0.003, 0.004, 0.005, 0.007, 0.008, 0.009, 0.01, 0.02, 0.03, 0.04, 0.05, 0.06, 0.07, 0.08, 0.09, 0.1, 0.2, 0.3, 0.4, 0.6, 0.7, 0.8, 0.9, 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 51, 52, 53, 54, 55, 56, 57, 58, 59, 60, 61, 62, 63, 64, 65, 66, 67, 68, 69, 70, 71, 72, 73, 74, 75, 76, 77, 78, 79, 80, 81, 82, 83, 84, 85, 86, 87, 88, 89, 90, 91, 92, 93, 94, 95, 96, 97, 98, and 99 L/min.

Figure 7:
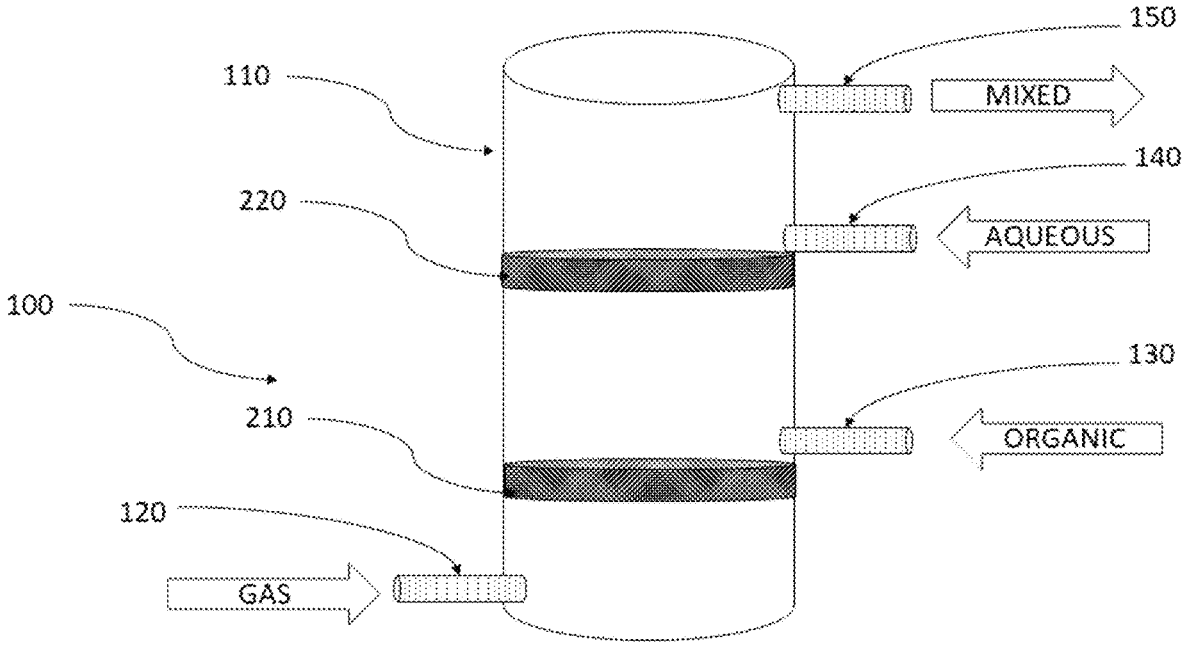
FIG. 7 shows an exemplary cross-section of the dispersion module of the GAME system.

The GAME reactor dispersion module is depicted in FIG. 7, with the reactor 100 including a dispersion module 110 operably connected to a gas feed 120, an organic phase feed 130 thereabove, and an aqueous phase feed 140 above both. A first membrane or filter 210 rests in the reactor 100 at or below the plane of entry of organic phase feed 130 and a second membrane or filter 220 rests in the reactor 100 at or below the plane of entry of the aqueous phase feed 140. The reactor 100 further includes an exit port 150 at or near the top portion of the reactor 100 where mixed phases can depart.

Metal Solution Preparation

In aspects, the processes of the present disclosure can include preparing a metal solution with desired low concentration metals contained therein. For example, as described herein, the GAME reactor and methods can extract or retrieve low concentration metals from an aqueous solution. Accordingly, aspects of the present disclosure concern preparing the aqueous solution. In some aspects, the aqueous solution is prepare by at least one leaching step. In some aspects, the aqueous solution is prepared by at least two leaching steps. It will be appreciated that for some metals, it is desirable to remove other metals first, such as those more abundant in concentration.

In aspects, the solution is prepared from sources that are likely to contain desirable metal(s), such as an ore, waste, acid mine drainage and landfill. It is accordingly a further objective to obtain the metal(s) in an aqueous solution. In some aspects, the metal(s) may be leached into a metal solution, such as through the treatment with one or more leachants. Examples of such may include a mineral acid, an inorganic acid, a salt, an oxidizing agent, a reducing agent, a complexing agent, and/or a base. The leachant concentration may be of about 0.1 M to about 10 M, including 0.3, 0.4, 0.5, 0.6, 0.7, 0.8, 0.9, 1, 2, 3, 4, 5, 6, 7, 8, and 9 M.

In some aspects, it may require additional steps before the material can be treated with a leachant to obtain a metal solution. For example, in some aspects, the present disclosure concerns metal recovery from PCBs. As described herein, due to the complex composition of WPCBs, the recovery process usually involves physical separation, pyrometallurgy, and hydrometallurgy (Guo et al., 2011 Waste Manag, 31(9-10), 2161-2166; Kaya, 2016 *Waste Manag,* 57, 64-90; Murthy et al., 2003 *Hydrometallurgy,* 68, 125-130; Tuncuk et al., 2012 *Minerals Engineering,* 25(1), 28-37; Wang et al., 2017 *Resources, Conservation and Recycling,* 126, 209-218). Regarding disadvantages, physical processes have low recovery efficiency and high energy consumption due to the grinding requirements needed to fully liberate valuable components. Pyrometallurgy requires special equipment for high-temperature operation, generating dust and toxic gaseous pollutants. In contrast, hydrometallurgy exhibits many advantages, including high leaching efficiency, a good operating environment, and a continuous and automated process (Hao et al., 2020 *Resources, Conservation and Recycling,* 157). However, chemicals used to extract metals through hydrometallurgy (e.g., mineral acids) must be treated before being discharged, otherwise, they can cause harm to the local environment and ecosystem. Other methods such as bioleaching and biodegradation, which produce less contamination, are also being widely investigated (Gurung et al., 2013 *Hydrometallurgy,* 133, 84-93; Xia et al., 2018 *Resources, Conservation and Recycling,* 136, 267-275). Overall, the integrated application of individual technologies is generally required for all metals' efficient and complete recovery.

The first step in WPCBs recycling is to separate the electrical components from the motherboards and classify them according to the composition of the elements. For better enrichment of valuable metals, the sorted parts are usually mechanically crushed into smaller size particles and then the metal fraction is finally separated from the non-metal fraction by using magnetic, electrical, or density separation techniques for the next step of precise recovery. Typically, solid metals are first dissolved in an aqueous solution using leaching agents and then recovered by solvent extraction, electrorefining, or chemical reduction processes. The leaching of which generally requires using mineral acids and oxidizers since most metals are present as the elementary substance or alloys in the PCBs (Konate et al., 2022 *Waste Manag,* 139, 17-24). While, precious metals, such as gold and silver, require the use of special leaching agents due to their inactive and stable nature. Cyanide leaching has been widely used due to the high efficiency of gold dissolution. However, this method produces toxic wastewater, which causes serious damage to the ecosystem and the environment (Eisler & Wiemeyer, 2004 *Reviews of Environmental Contamination and Toxicology* (pp. 21-54). Springer New York). Aqua regia is another leaching agent commonly used to dissolve gold (Cyganowski et al., 2017 *Journal of Saudi Chemical Society,* 21(6), 741-750). However, due to the strongly oxidizing properties of aqua regia and its high corrosiveness to equipment, this method has usually been applied only for laboratory experimental studies. Besides, researchers have investigated various non-toxic and more environmentally friendly gold leaching agents, such as thiosulfate and thiourea (Ha et al., 2010; Ubaldini et al., 1998 *Hydrometallurgy,* 48, 113-124). Sahin et al. reported that 100% gold recovery was achieved by using the iodine-hydrogen peroxide ($I_2$—$H_2O_2$) solution (Sahin et al., 2015 *Separation Science and Technology*. doi.org/10.1080/01496395.2015.1061005). Meanwhile, the bioleaching (Arshadi et al., 2021 *Journal of Material Cycles and Waste Management,* 24(1), 83-96; Işildar et al., 2019; Kaur et al., 2022 *Sustainability,* 14(2); Xia et al., 2018) and green leaching (Oraby et al., 2020 *Waste and Biomass Valorization,* 11(8), 3897-3909) methods are also being investigated.

Solvent extraction is often used to further separate and purify the gold from the leaching solution. Di(2-ethylhexyl) phosphoric acid (D2EHPA) is a common extractant with selective extraction effects on different metals at different equilibrium ph (Sole, 2008). The use of D2EHPA as an extractant to purify gold from acidic thiourea solutions has been studied. Kim et al. found that the gold-thiourea complex was solubilized with five molecules of D2EHPA monomer by studying the stoichiometric relationships (Kim et al., 1995 *Hydrometallurgy,* 38, 7-13). Jalil et al. achieved a gold extraction rate of 91.5% by using a single D2EHPA (Jalil et al., 2018 *Recovery of gold in solution from electronic waste by di(2-ethylhexyl) phosphoric acid*), and found that the synergistic extraction of D2EHPA-isodecanol can achieve a 99.4% of gold extraction rate (Jalil et al., 2019 IOP *Conference Series*: Materials Science and Engineering). Meanwhile, other extractants are also studied for the extraction of gold, such as N—(N,N-di(2-ethylhexyl) aminocarbonylmethyl) glycine (D2EHAG), diethylene glycol dibutyl ether (dibutyl carbitol), and tributyl phosphate (TBP) (Kubota et al., 2019 *Separation and Purification Technology,* 214, 156-161; Mironov, 2012 *Russian Journal of Inorganic Chemistry,* 57(11), 1513-1519; Sadeghi & Alamdari, 2016 *Transactions of Nonferrous Metals Society of China,* 26(12), 3258-3265). In the chemical precipitation step, sodium borohydride ($NaBH_4$) can be used to reduce gold (>99%) and silver rapidly in acidic solutions of thiourea, thiocyanate, sulfonate, acid chloride, and acid nitrate at ambient temperature (Awadalla & Ritcey, 1991 *Separation Science and Technology,* 26(9), 1207-1228; Hohnstedt et al., 1965 *ANALYTICAL CHEMISTRY,* 37(9)). Behnamfard et al., reported the precipitation of 100% gold and silver from copper removal thiourea leach solution in only 15 minutes at room temperature using an 8 g/l sodium borohydride (Behnamfard et al., 2013 *Waste Management,* 33(11), 2354-2363). Besides sodium borohydride, a simple tertiary diamide was found can selectively precipitate gold from acidic aqueous solutions (Kinsman et al., 2021 *Nature Communications,* 12(1), 6258). Other methods for gold recovery include activated carbon adsorption (Li et al., 2018 *Resources, Conservation and Recycling,* 139, 122-139), adsorption based on ionic resin exchange (Dong et al., 2017 doi.org/10.3390/met7120555; Firlak et al., 2014 *Journal of Water Process Engineering,* 3, 105-116; Gurung et al., 2013 *Hydrometallurgy,* 133, 84-93; Wu et al., 2017 *Journal of Cleaner Production,* 246), adsorption using natural starch with low porosity (Lin et al., 2021 *Journal of Cleaner Production,* 328), and electrodeposition (Lekka et al., 2015 *Hydrometallurgy,* 157, 97-106; F. Li et al., 2019 *Journal of Cleaner Production,* 213, 673-679).

The most widely used separation and purification process in extractive metallurgy is bulk solvent extraction (BSX). Here, the aqueous leaching solution is vigorously mixed with an organic solvent, which is doped with a carefully selected ligand that facilitates the selective recovery of valuable elements into the solvent. Industrially, BSX is applied in large continuous mixer-settler reactors with numerous countercurrent stages that are required for selective recovery. Despite its widespread utility in the minerals industry, BSX tends to be ineffective or even unviable for the selective recovery of low-concentration precious metals (e.g., Au and Ag) from the complex leaching solutions of WPCBs. This is the case because solvent extraction requires adequate mixing between the organic extractants and aqueous leaching solution. Due to the extremely dilute concentration of Au and Ag, BSX needs a long period of time to build up their concentration in the organic phase. This inevitably results in high consumption of chemicals and energy.

This long loading time for the organic phase to reach critical saturation values can be shortened by applying a high aqueous-to-organic phase (A/O) ratio. But for the case of BSX, a high A/O ratio would severely compromise the extraction efficiency (i.e., the percentage of target metals recovered). An alternative to BSX is liquid-liquid two-phase microflow extraction (LLME), which uses well-defined microchannels that provide a large specific interfacial area and a short diffusion length for the solutions. As a result, LLME can achieve a mass-transfer rate that is several orders-of-magnitude higher than BSX and thus can significantly reduce the loading time. Nevertheless, once the dimension of the microchannels is fixed, higher A/O ratio will increase the mass transfer distance and reduce the extraction efficiency. Consequently, although LLME methods do manage to preserve a reasonable extraction efficiency under moderately high A/O ratio, its performance could still be impaired when the A/O ratio is extremely high.

Figure 8:
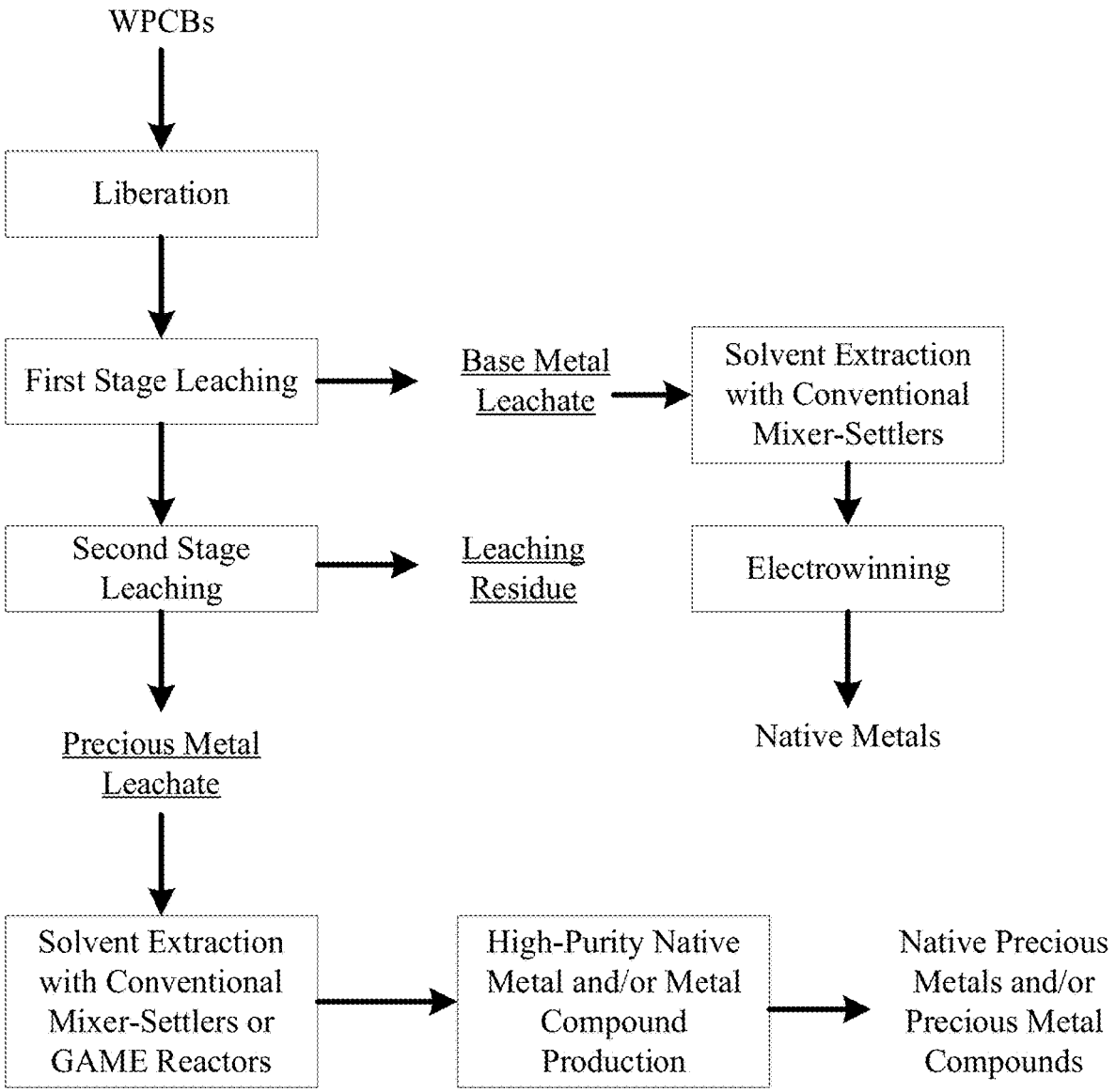
FIG. 8 shows a flowsheet for metal recovery from WPCBs.

FIG. 8 shows a flowsheet combining a two-step leaching process that can then feed into the GAME system. WPCBs are first fed to a liberation step to separate metallic from non-metallic fractions. Different methods, such as combustion and physical separation (crushing and grinding followed by metal recovery), can be used in this step. After liberation, the metallic fraction is leached in two stages with different lixiviants under different conditions. As a result, the base and precious metals are leached separately, leading to two leach solutions (base metal leach solution and precious metal leach solution). The base metal solution is processed through solvent extraction using conventional mixer-settlers, resulting in high-purity solutions of base metals. Then, electrowinning is used to produce native base metals. Depending on the concentration of precious metals in the precious metal leach solution, solvent extraction with conventional mixer-settlers or GAME reactors is used to separate and purify the precious metals. Conventional mixer-settlers are suitable for high-concentration solutions, while GAME reactors are efficient in processing low-concentration solutions. After separation and purification, native precious metals or precious metal compounds can be generated through appropriate methods, such as precipitation.

In some aspects, combustion may also be used as an initial step, followed by leaching to obtain the aqueous phase. Combustion may be used to liberate base and precious metals from WPCBs at a temperature to maximize the removal of non-metal fractions while retaining metal fractions, such as 800° C.± 100° C. After combustion, the solid residue may be treated and then sieved with a desired aperture, such as 0.5 mm aperture, to screen the milled product, resulting in two fractions, such as ash with sizes finer than 0.5 mm and copper foils with sizes coarser than 0.5 mm. The ash can then be used for leaching feed. Common leaching methods use mineral acids to dissolve metals from solids into solution. To achieve the maximum leaching recovery of metals, various leaching factors, including temperature, lixiviant concentration, and leaching duration can be varied. For example, the examples herein demonstrate that increased temperature and acid concentration improved the amount of metal dissolved. In some aspects, a second or more leaching step may be used. As set forth in the examples, a first leaching step can be performed with an acid, such as hydrochloric acid, followed by leaching with an oxidizing agent (such as hydrogen peroxide), a sulfate (such as ammonium thiosulfate), and/or an amine (such as urea and/or thiourea).

EXAMPLES

Recovery of Rees in Allanite Ore

The column of the dispersion module was made of borosilicate glass, which had three inputs for the gas, aqueous, and organic phases, and one output for the mixed phase. Two fritted glass filter discs with a pore size of 10 to 16 micrometers were inserted in the column. Two glass syringes and two precise syringe pumps were used to input the aqueous phase and organic phase into the dispersion module, respectively. The aqueous phase containing REEs was the liquid leachate of Allanite ore. The organic phase contained extractants effective for REEs. After the solvent extraction happened in the dispersion module, the nitrogen gas was collected. Meanwhile, the aqueous raffinate and loaded organic phase were also collected in a separate container for further phase separation. The loaded organic phase concentrated with REEs was then processed by scrubbing, stripping, precipitation, and other downstream processing to produce rare earth oxide. When the gas flowed through the bottom filter disc, gas bubbles were generated in the organic phase. When the gas bubbles and the organic phase flowed through the above filter disc, three different bubbles were generated in the aqueous phase, which were gas bubbles, organic droplets, and gas bubbles coated with the organic phase. Those bubbles were dispersed in the aqueous phase to conduct the solvent extraction processing. As shown in FIG. 6, the real gas bubbles, organic droplets, and gas bubbles coated with the organic phase were observed in the dispersion module with a microscope.

Figure 9:
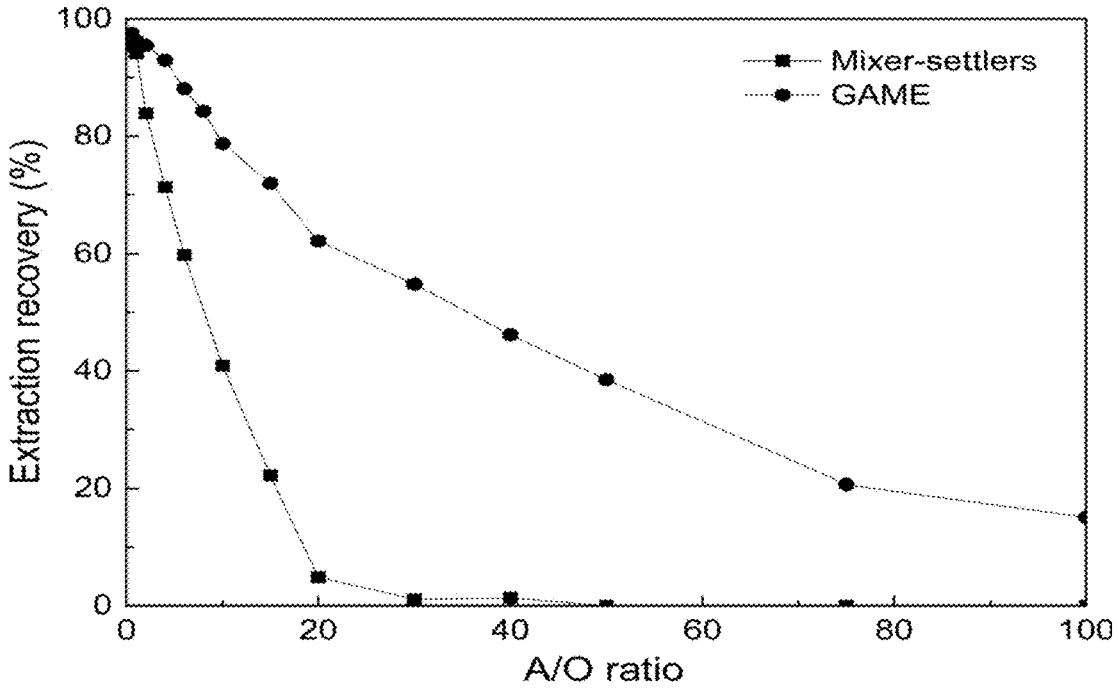
FIG. 9 shows the extraction performance of using the GAME system and conventional mixer-settlers separately.
Figure 10:
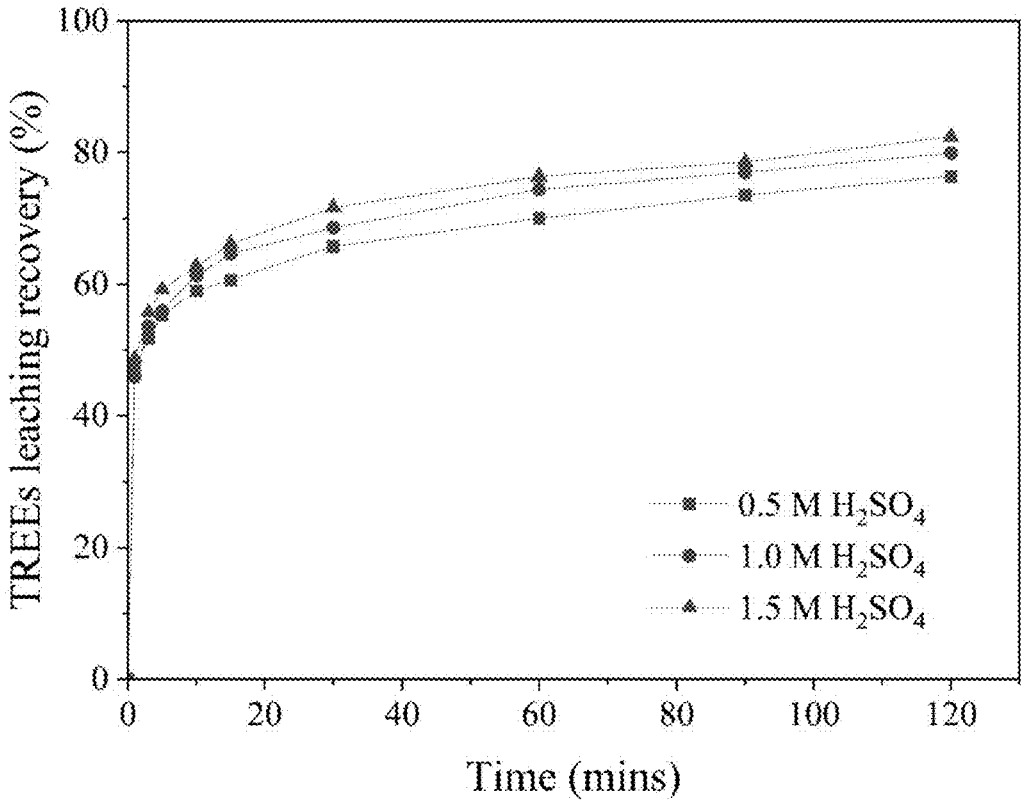
FIG. 10 shows the effect of acid concentration on the leaching performance.
Figure 11:
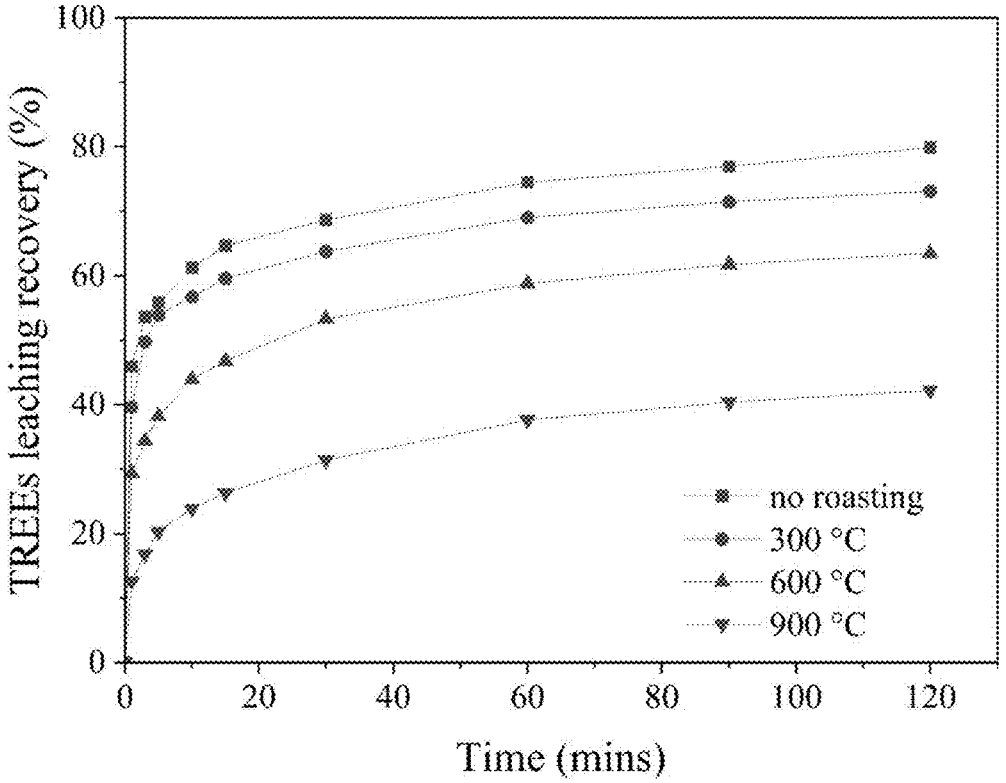
FIG. 11 shows the effect of roasting on the leaching performance.
Figure 12:
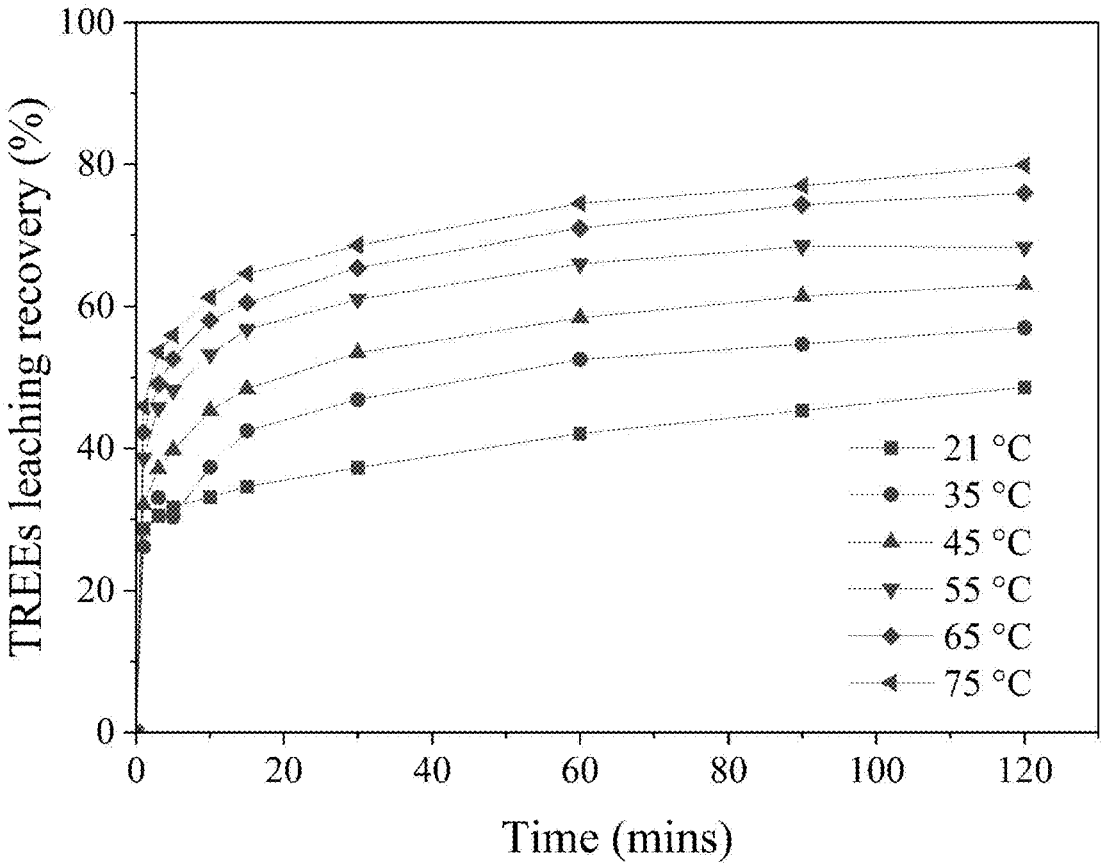
FIG. 12 shows the effect of temperature on the leaching performance.
Figure 13:
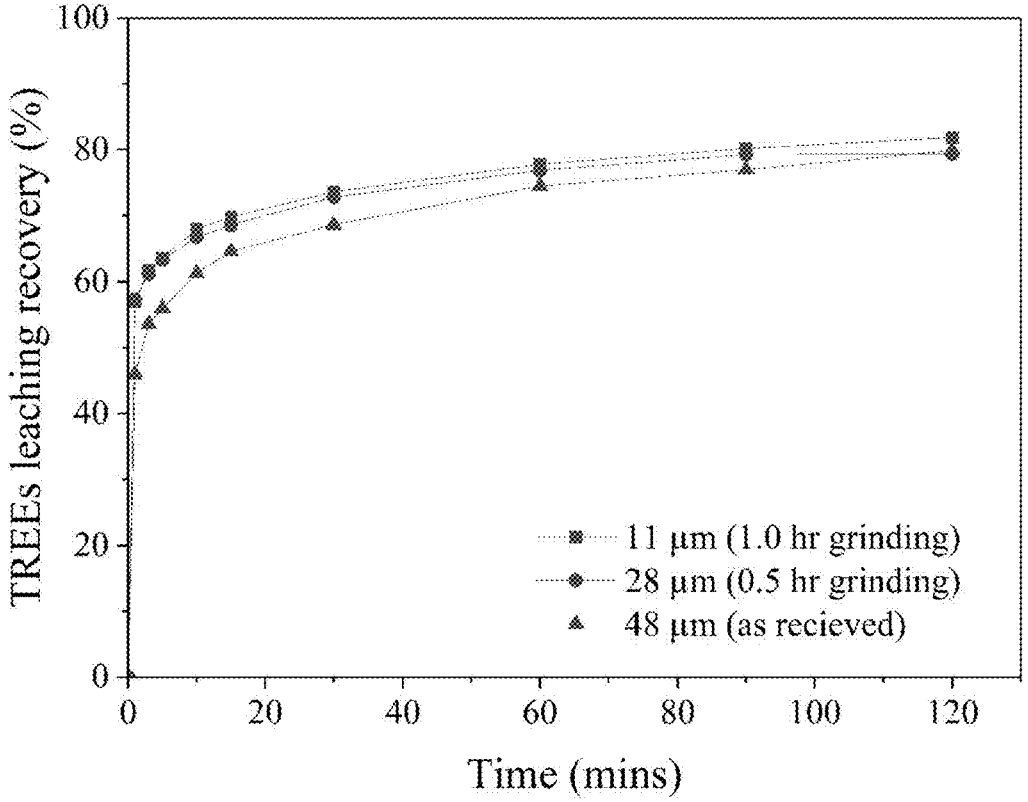
FIG. 13 shows the effect of the particle size on the leaching performance.

Preliminary solvent extraction tests were performed by using the GAME system and conventional mixer settlers at various A/O ratios. The aqueous phase was a synthetic nitric-based neodymium solution with a concentration of 10 ppm. The organic phase was prepared by using Di(2-ethylhexyl)phosphoric acid (D2EHPA) as the extractant with a concentration of 0.1 M and kerosene as the diluent. As shown in FIG. 9, the extraction recovery dropped dramatically from around 98% to 5% when the A/O ratio increased from 0.5 to 20 by using mixer settlers. However, the extraction recovery was around 40%, even when the A/O ratio was 50 by using the GAME system. The solvent extraction results show the advantages of the GAME system in high A/O ratio conditions compared to the conventional mixer settlers.

Allanite ore provided by the Western Rare Earth Company was the feed for this project. The Allanite sample received has been treated by grinding and magnetic separation to concentrate REEs in the solids. The characterization study and leaching study of the Allanite sample were conducted to maximumly dissolve REEs into the liquid leaching solution. As shown in Table 1, in the Allanite solid sample, there was around 86980.7 ppm of aluminum, 9766.7 ppm of calcium, and 77871.6 ppm of iron. The concentration of total REEs (TREEs) in the Allanite sample was 9861.3 ppm. Various experimental factors were investigated on the leaching performance of the Allanite sample, including particle size, roasting, acid type and concentrations, and temperature. The results are shown in FIG. 10 to FIG. 13. Overall, above 80% of REEs in the Allanite solid sample were dissolved into the liquid-leaching solution.

Metal Recovery from Waste Pcbs

Figure 14:
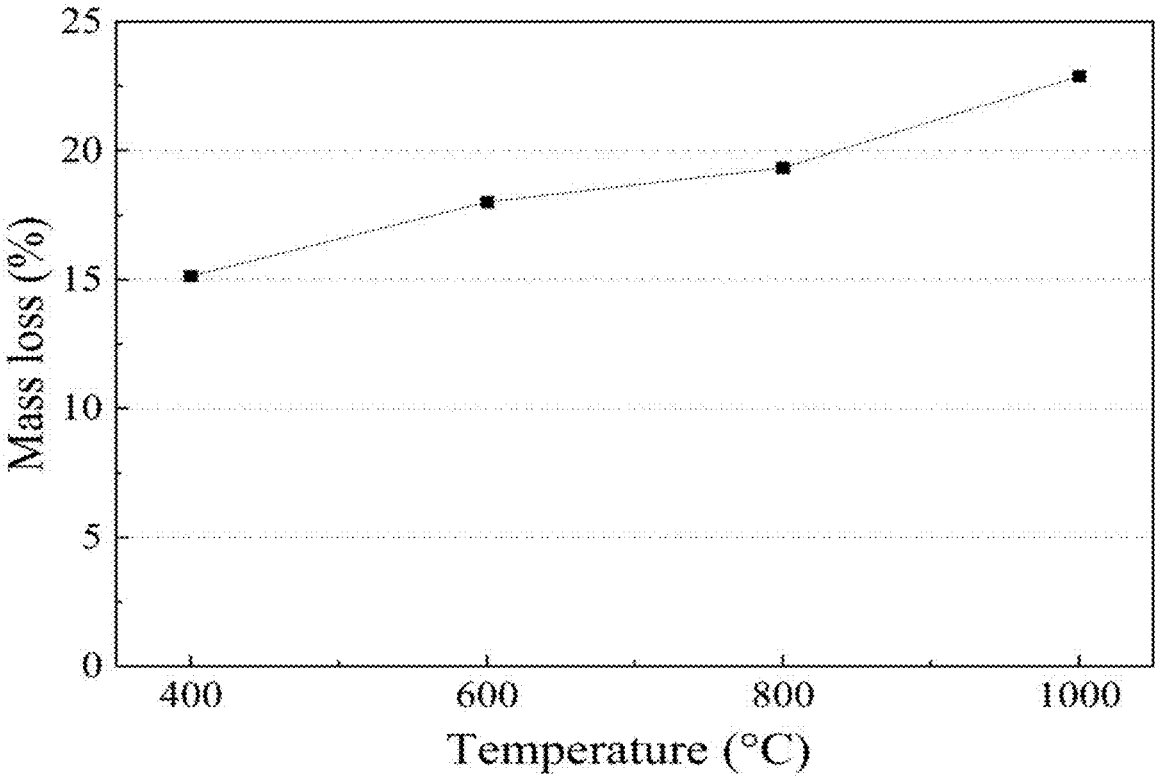
FIG. 14 shows mass loss of WPCBs during combustion at various temperatures.

As shown in FIG. 14, the mass loss of WPCBs in this study increased from around 15% to 18%, when the combustion temperature increased from 400° C. to 600° C. The main reason is that most combustible non-metal fractions reacted at 200° C. to 600° C. to form gaseous products, leading to the majority of the mass loss. Meanwhile, when the temperature was raised from 600° C. to 800° C., the mass loss was only raised by around 1% because the remaining residue, such as metal alloy, was relatively stable and did not react to form gas products at this temperature range. However, when the temperature was increased from 800° C. to 1000° C., the mass loss was increased by around 3%. The reasonable explanation is that, during this temperature range, the boiling point of some native metals (e.g., zinc) and reaction products (e.g., copper (II) bromine) generated during the combustion were achieved, which leading to the vaporization.

Figure 15:
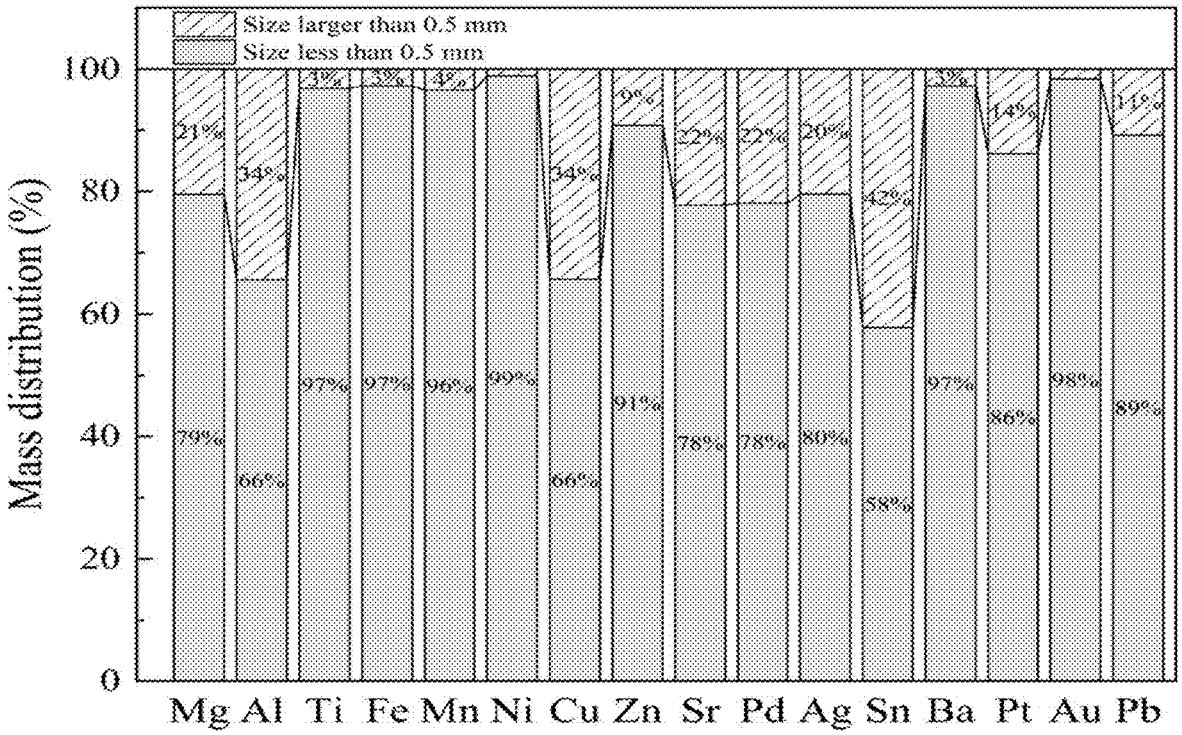
FIG. 15 shows mass distribution of base and precious metals in the 800° C. combustion residue with two different size fractions.

After combustion, the solid residue was treated by hand milling with an agate mortar and pestle. Then a sieve with 0.5 mm aperture was used to screen the milled product, resulting in two fractions, namely, ash with sizes finer than 0.5 mm and copper foils with sizes coarser than 0.5 mm. FIG. 15 shows the mass distribution of metals in the two fractions of solid residue after combustion at 800° C. Since copper is the most abundant base metal, and gold is the most valuable precious metal in WPBCs, the analysis focused on these two elements. It was found that, after combustion, 98 wt. % of the gold remained in the ash. Meanwhile, 34 wt. % of the copper, 34 wt. % of the aluminum, 43 wt. % of the tin, and some other base metals remained in the copper foils. Furthermore, Table 1 shows the metal concentrations in these two solid residue fractions after combustion at 800° C. The concentration of gold in the ash was 420.68 ppm, while this number was only 13.42 ppm in the copper foils. After the screening, the concentration of copper, aluminum, and tin in the ash was obviously decreased. In summary, it was proved that after combustion and hand milling, almost all gold was enriched in particles finer than 0.5 mm. The screening process facilitated the removal of some abundant metals (e.g., Cu, Al, Sn), while retaining the gold in the ash, which is beneficial for the subsequent separation and purification steps.

TABLE 1

Concentrations of base and precious metals in the 800° C. combustion residue with two different size fractions.

| Element | <0.5 mm | >0.5 mm |
|---|---|---|
| | Unit (%) | |
| Cu | 31.95 | 32.66 |
| Al | 1.54 | 1.58 |
| Ni | 1.14 | 0.02 |
| Fe | 0.98 | 0.05 |
| Ti | 0.38 | 0.02 |
| Zn | 0.22 | 0.04 |
| Sn | 0.80 | 1.15 |
| Ba | 1.56 | 0.09 |
| | Unit (ppm) | |
| Au | 420.68 | 13.42 |
| Ag | 911.75 | 458.43 |
| Pd | 8.31 | 4.55 |
| Pt | 0.04 | 0.01 |
| Mg | 1153.40 | 582.15 |
| Mn | 106.74 | 7.58 |
| Sr | 394.18 | 220.70 |
| Pb | 255.99 | 60.98 |

The metals present in WPCBs are in the form of native metals or alloys. Therefore, preliminary leaching experiments were performed with three different leaching solutions respectively. The first leaching solution used was 2 M hydrochloric acid alone. The second leaching solution used was 2 M hydrochloric acid containing 5 vol. % hydrogen peroxide, which was used as an oxidizing agent. The third leaching solution used was 2 M hydrochloric acid containing 0.1 M hydroxylamine hydrochloride, which was used as a reducing agent. All the leaching experiments were performed with a solid/liquid ratio value of 0.05 g/ml at 75° C. for two hours. The results shown in FIG. 16 indicated that above 98% of copper can be easily leached into solution with only hydrochloric acid. A possible reason is that copper was already oxidized and formed compounds during the combustion. Chemical reactions related to copper during the process are shown in Equation 1 to Equation 3. As a non-oxidizing acid, hydrochloric acid should not react significantly with copper in its native metal form. Also, the oxidation process of copper by the oxygen in the air at room temperature and atmospheric pressure is very slow. Therefore, copper was most likely oxidized during combustion by oxygen to form copper dioxide, or react with other elements, such as bromine, to form compounds. When metals in WPCBs are liberated through physical separations, an oxidizing agent can be added into the acid leaching system to improve the dissolution of native copper.

$$Cu+2HCl_{(aq)}=CuCl_2+H_{2(g)}\Delta G^\circ_{80}=92.577\ kJ/mol \quad \text{Equation 1}$$

$$CuO+2HCl_{(aq)}=CuCl_2+H_2O\Delta G^\circ_{80}=-33.730\ kJ/mol \quad \text{Equation 2}$$

$$2Cu+O_{2(g)}=2CuO\ \Delta G^\circ_{700}=\sim 68.504\ kJ/mol \quad \text{Equation 3}$$

Figure 16:
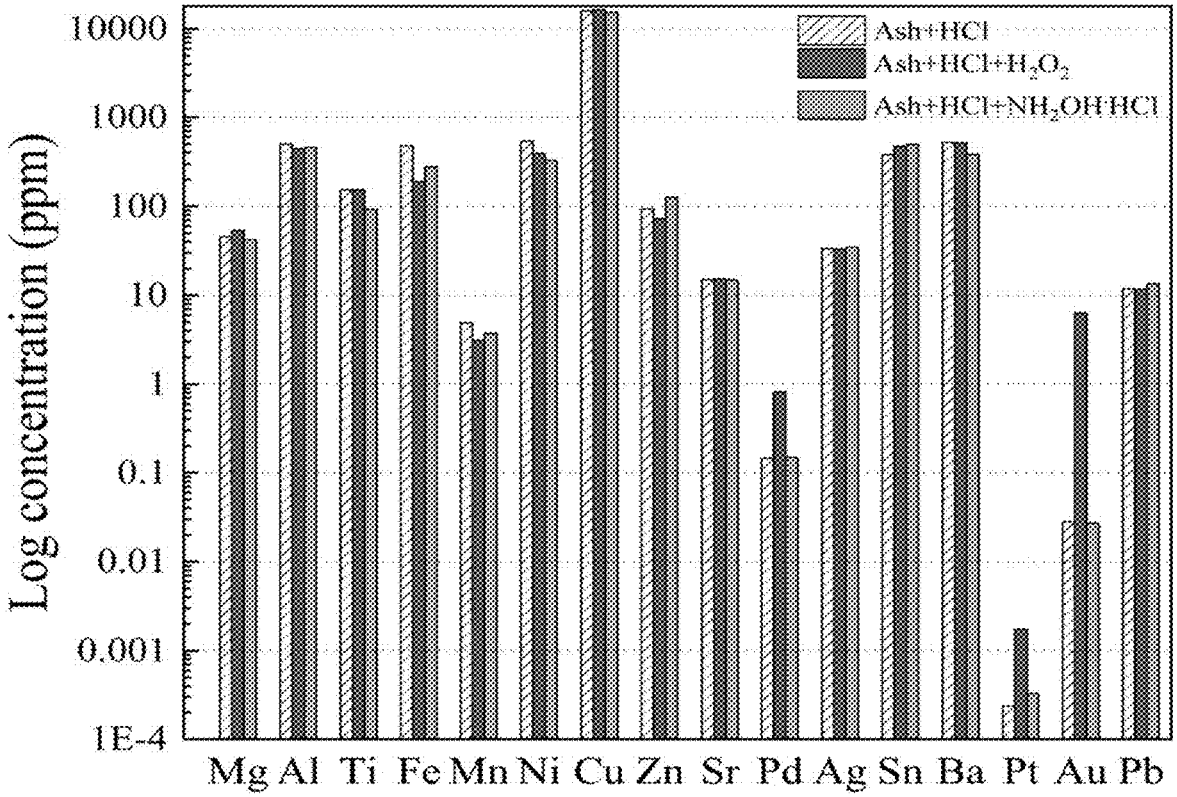
FIG. 16 shows concentration mass recovery (right) of elements in three different leaching solutions separately.
Figure 17:
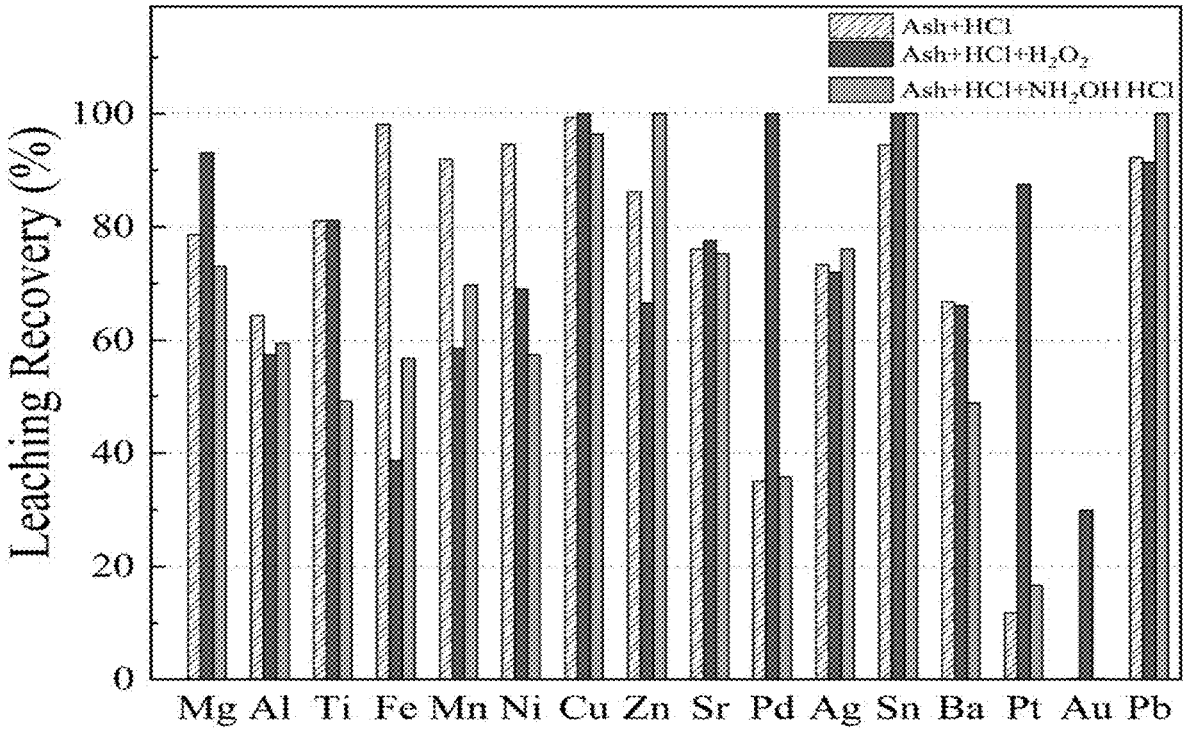
FIG. 17 shows leaching mass recovery of elements in three different leaching solutions separately.

The results shown in FIG. 16 and FIG. 17 also indicated that almost no gold was dissolved when using hydrochloric acid or hydrochloric acid plus hydroxylamine hydrochloride. Around 30% of the gold was dissolved using hydrochloric acid plus hydrogen peroxide. This is because gold is very stable compared to other metals, so it remained in its native metal form during the combustion. In summary, a certain degree of separation of the gold and copper present in the feed can be achieved through two-stage leaching under different leaching conditions. This will facilitate the subsequent solvent extraction process due to the considerable removal of the most abundant base metal in WPCBs. At the first leaching stage, only hydrochloric acid was used to dissolve copper and other base metals, and the leachate was then used as a feed for copper recovery in the downstream processing. After the first leaching stage, the solid residue containing gold was dried and used as a feed for the second leaching stage, where effective lixiviants were used to dissolve the gold.

TABLE 2

The concentrations of metals in solids and solutions at different processing stages.

| | Processing stages | | | |
|---|---|---|---|---|
| Metals | Leaching solid feed (<0.5 mm ash) (mg/kg) | PLS (mg/L) | Loaded organic phase (mg/L) | Stripping solution (mg/L) |
| Au | 420.68 | 50.99 | 17.48 | 14.96 |
| Ag | 911.75 | 53.76 | 2.84 | 0.39 |
| Pd | 8.31 | 0.43 | 0.13 | 0.05 |
| Pt | 0.04 | 0.01 | 0.01 | 0.00 |
| Cu | 319,487.00 | 65.93 | 2.19 | 1.67 |
| Sn | 8,036.46 | 28.98 | 14.12 | 0.45 |
| Ba | 15,604.48 | 21.23 | 3.99 | 3.84 |
| Al | 15,407.45 | 12.30 | 6.02 | 0.50 |

TABLE 2-continued

The concentrations of metals in solids and solutions at different processing stages.

| Metals | Processing stages: Leaching solid feed (<0.5 mm ash) (mg/kg) | PLS (mg/L) | Loaded organic phase (mg/L) | Stripping solution (mg/L) |
|---|---|---|---|---|
| Ti | 3,775.80 | 1.76 | 0.75 | 0.05 |
| Fe | 9,758.42 | 2.48 | 1.15 | 0.05 |
| Ni | 11,395.40 | 6.42 | 0.28 | 0.22 |

Figure 18:
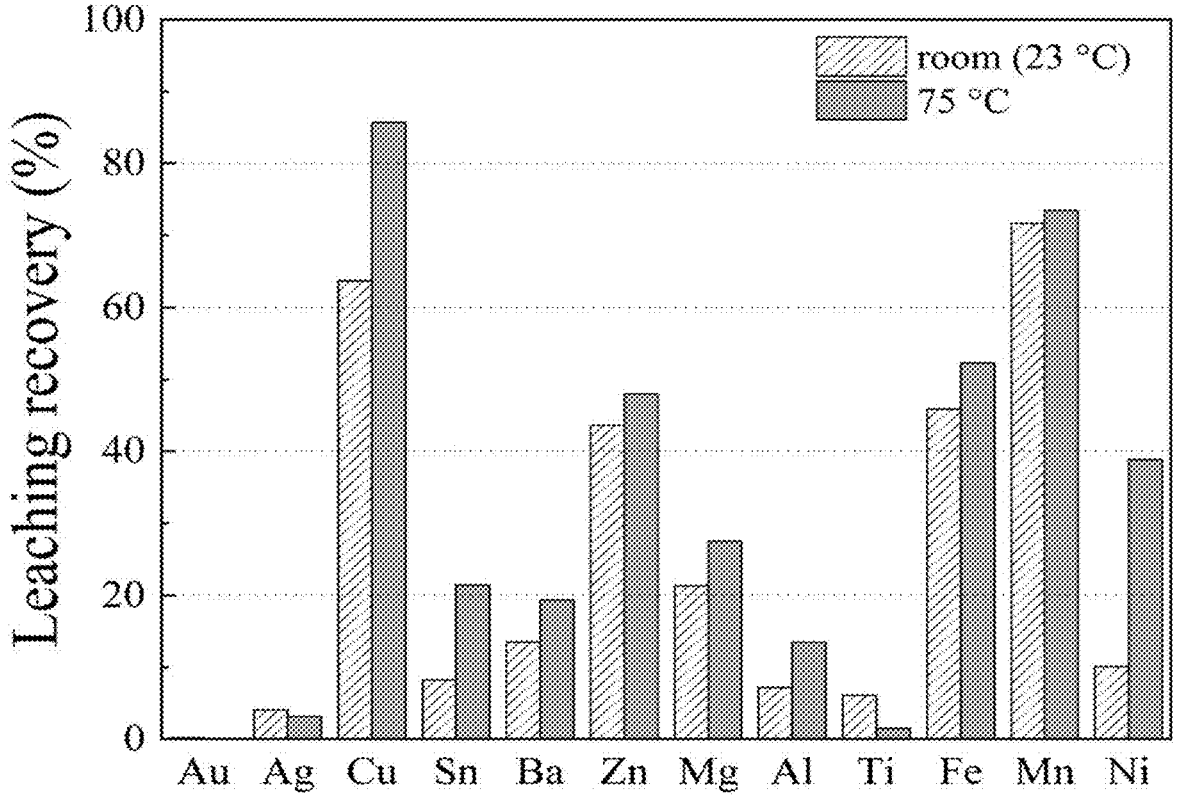
FIG. 18 shows the effect of temperature on leaching performance of the first leaching stage.
Figure 19:
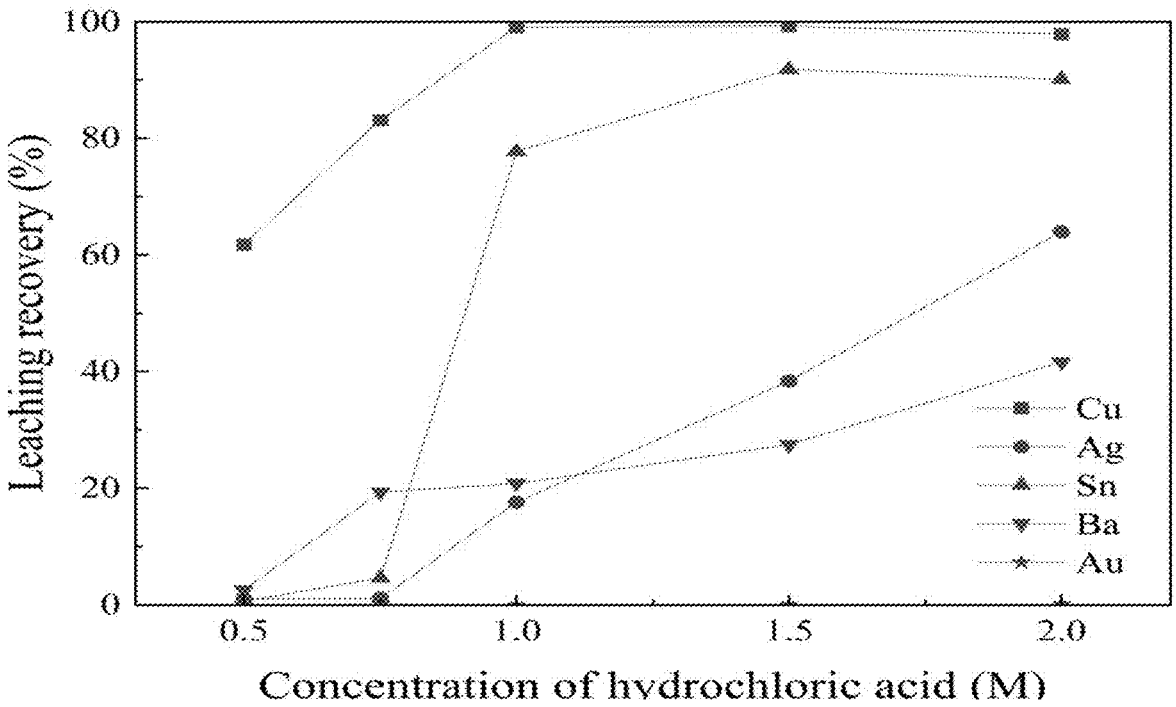
FIG. 19 shows the effect of hydrochloride acid concentration on leaching performance at the first leaching stage.

All leaching experiments were performed with a solid/liquid ratio of 0.05 g/ml. FIG. 18 shows the leaching performance with 0.75 M hydrochloric acid for one hour at room temperature (~23° C.) and 75° C., respectively, which indicates that, the leaching recoveries of nickel and copper were relatively sensitive to temperature. The leaching recovery of nickel increased from about 10% to nearly 40%, and the recovery of copper increased from about 63% to about 85%, when the leaching temperature increased from room temperature to 75° C. Meanwhile, when the leaching temperature increased, the leaching recoveries of most base metals were also improved. The recoveries of silver and titanium showed a mild decreasing trend when the leaching temperature increased. This could be because their recovery rate was very low (around 5%) and experimental data errors decreased their recovery rate. Increasing the temperature did not affect the leaching recovery of gold, which was almost zero. In summary, increasing the temperature benefits the leaching recovery of base metals such as copper. FIG. 19 shows the leaching performance at 75° C. for two hours with various concentrations of hydrochloric acid. The results indicate that, as the acid concentration increased, the leaching recovery of base metals also raised. When the concentration of hydrochloric acid was 1.0 M, the leaching recovery of copper reached almost 100%. When the concentration of hydrochloric acid increased from 0.75 M to 1.0 M, silver started to be leached out, and the leaching recovery of tin increased dramatically. Meanwhile, increasing the hydrochloric acid concentration did not affect the leaching recovery of gold, which was almost zero. In summary, at least 1.0 M hydrochloric acid was needed to achieve nearly 100% dissolution of copper.

Figure 20:
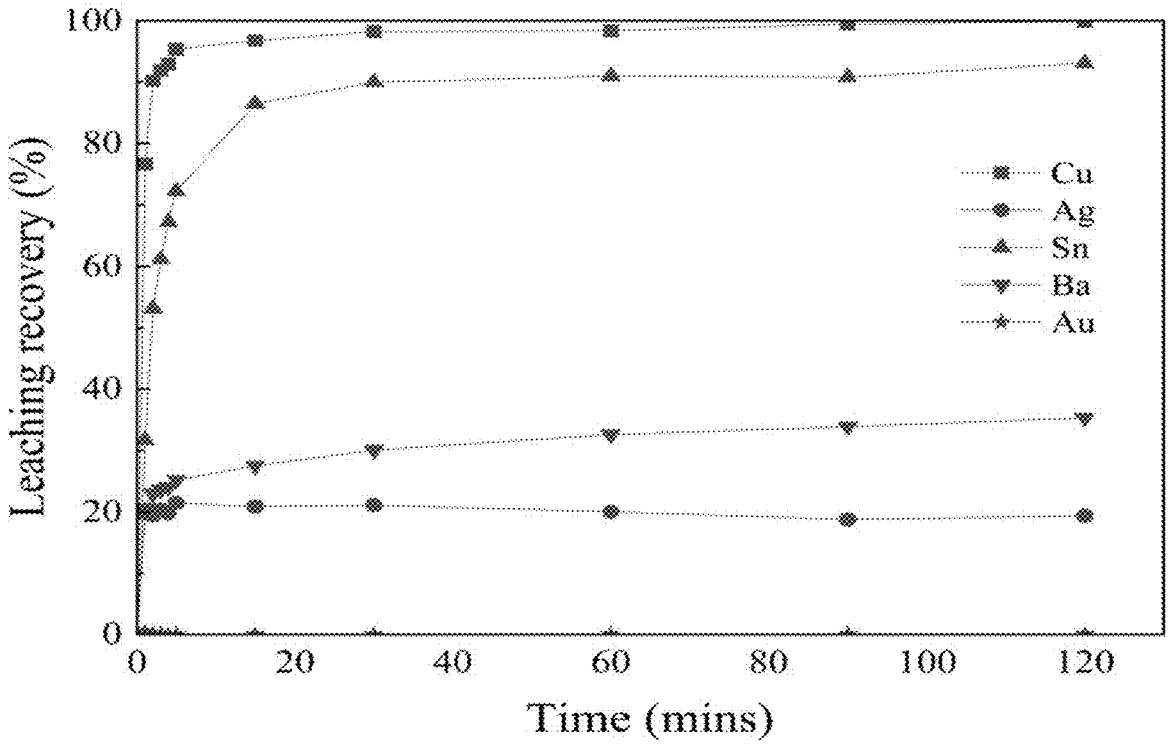
FIG. 20 shows leaching kinetics of the first leaching stage (1.0 M HCl 0.05 g/ml solid/liquid ratio, 75° C.).

FIG. 20 shows the change in the leaching recovery of various metals as a function of reaction time. The experiments were performed with 1.0 M hydrochloric acid at 75° C. The results indicated that the leaching reaction of base metals with hydrochloric acid occurred rapidly. Basically, after ten minutes of reaction, the recovery of base metals was close to reaching the maximum value, and thereafter the leaching recovery increased slowly with time. After one hour of reaction, almost all copper was dissolved. Meanwhile, increasing the leaching time did not affect the leaching recovery of gold, which was almost zero. Instead, a total of about 20% of the silver was leached out, which could be related to its form of existence (i.e., native metal or oxide), and liberation in solid particles after combustion. In summary of FIG. 18 to FIG. 20 the leaching recovery of base metals is positively correlated with the leaching temperature, lixiviant concentration, and reaction time. In the first leaching stage, almost all copper and zero gold were leached out when using 1.0 M hydrochloric acid with a solid/liquid ratio value of 0.05 g/ml at 75° C. for one hour.

Figure 21:
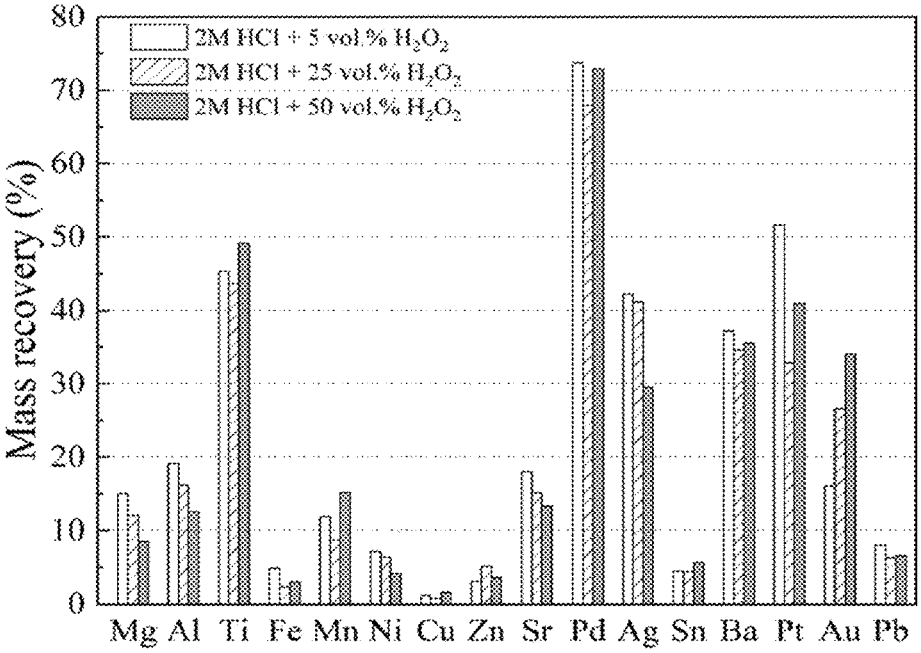
FIG. 21 shows metal leaching recovery by using 2 M HCl containing three different concentrations of H2O2 separately.

Second Stage Leaching—Hydrogen Peroxide: After the first leaching step, almost all copper and some base metals were removed from the feed material. The remaining material was dried and used as a feed in the second leaching stage to maximize the leaching recovery of gold. The native gold is chemically stable and requires special leaching agents to dissolve. Conventional lixiviants for gold leaching, such as cyanide and aqua regia, were not considered, for environmental reasons and to reduce pollution and health hazards. In the preliminary leaching experiments as shown in FIGS. 16 and 17, it was found that the addition of the oxidizing agent, namely hydrogen peroxide, had a solubilizing effect on gold, so the effect of hydrogen peroxide concentration on the leaching recovery of gold was first investigated. The experiments were performed with 2 M hydrochloric acid and a solid/liquid ratio value of 0.02 g/ml at 75° C. for two hours. It is worth mentioning that the predetermined volume of hydrogen peroxide was added to the flask in batches rather than all at once. This practice is designed to prevent a situation where hydrogens peroxide decomposes and loses its strong oxidizing properties before it can react with gold. The results shown in FIG. 21 indicated that, increasing the concentration of hydrogen peroxide in the leach solution can enhance the gold leaching recovery. However, when the leach solution contained 50 vol. % of hydrogen peroxide, the gold leaching recovery was only about 35%, which was unsatisfactory. In summary, hydrogen peroxide as an oxidizing agent with hydrochloric acid can partially dissolve the gold elementary substance but cannot reach satisfactory values.

Figure 22:
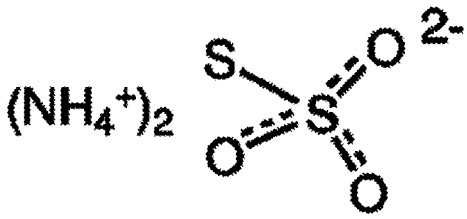
FIG. 22 shows the molecular structure of ammonium thiosulfate.

Second Stage Leaching—Ammonium Thiosulfate: The second leaching agent investigated was ammonium thiosulfate, whose molecular structure is shown in FIG. 22. The advantages of thiosulfate are reflected in its low environmental risk, high selectivity, low corrosiveness, and low-cost. Because thiosulfate is unstable in acidic solutions and can be easily decomposed, the pH value of thiosulfate leaching solution is generally between pH 9 to 10.5. It is worth noting that gold dissolves very slowly in alkaline thiosulfate solutions in the absence of a catalyst. To improve the leaching efficiency, Copper (II) and ammonia are usually used as additives to produce copper ammonia ($Cu(NH_3)_4^{2+}$) as a catalyst, resulting in an 18 to 20-fold increase in leaching rate. The nature of the thiosulfate leaching reaction is an electrochemical process consisting of gold oxidation at the anode and oxygen reduction at the cathode, and the associated reactions are expressed in Equation 4 to Equation 10.

$$4Au + 8S_2O_3^{2-} + O_2 + 2H_2O \rightarrow 4Au(S_2O_3)_2^{3-} + 4OH^- \Delta G^0 = -97.9 \text{ kJ/mol} \quad \text{Equation 4}$$

$$Au \rightarrow Au^+ + e \Delta G^0 = -163.2 \text{ kJ/mol} \quad \text{Equation 5}$$

$$Au^+ + 2NH_3 \rightarrow Au(NH_3)_2^+ \Delta G^0 = -74.1 \text{ kJ/mol} \quad \text{Equation 6}$$

$$Au(NH_3)_2^+ + 2S_2O_3^{2-} \rightarrow 2NH_3 + Au(S_2O_3)_2^{3-} \Delta G^0 = -74.9 \text{ kJ/mol} \quad \text{Equation 7}$$

Equation 4 indicates the total leaching reaction. Equation 5 to Equation 7 show the reactions that occurred in the anodic part. First ammonia complexes with gold ions, resulting in the complex $[Au(NH_3)_2]^+$. Then ammonia is replaced by thiosulfate ions, forming the more stable complex $[Au(S_2O_3)_2]^{3-}$.

$$Cu(NH_3)_4^{2+} + 3S_2O_3^{2-} + e \rightarrow Cu(S_2O_3)_3^{5-} + 4NH_3 \Delta G^0 = -21.9\ kJ/mol \quad \text{Equation 8}$$

$$4Cu(S_2O_3)_3^{5-} + 16NH_3 + O_2 + 2H_2O \rightarrow 4Cu(NH_3)_4^{2+} + 4OH^- + 12S_2O_3^{2-} \Delta G^0 = -67.1\ kJ/mol \quad \text{Equation 9}$$

Equation 8 and Equation 9 show the reactions that occurred in the cathodic part. $[Cu(NH_3)_4]^{2+}$ was reduced to $[Cu(S_2O_3)_3]^{5-}$, which then oxidized back into $[Cu(NH_3)_4]^{2+}$ by dissolved oxygen in the solution. Therefore, $[Cu(NH_3)_4]^{2+}$ as a catalyst helps with oxygen reduction reaction.

$$2Cu(NH_3)_4^{2+} + 8S_2O_3^{2-} \rightarrow 2Cu(S_2O_3)_3^{5-} + S_4O_6^{2-} + 8NH_3\ \Delta G^0 = -19.8\ kJ/mol \quad \text{Equation 10}$$

Meanwhile, it is noteworthy that the relatively strong oxidation capacity of $[Cu(NH_3)_4]^{2+}$ can also accelerate the decomposition of thiosulfate (as shown in Equation 10). Therefore, the copper and ammonia concentrations should be controlled appropriately.

Figure 23:
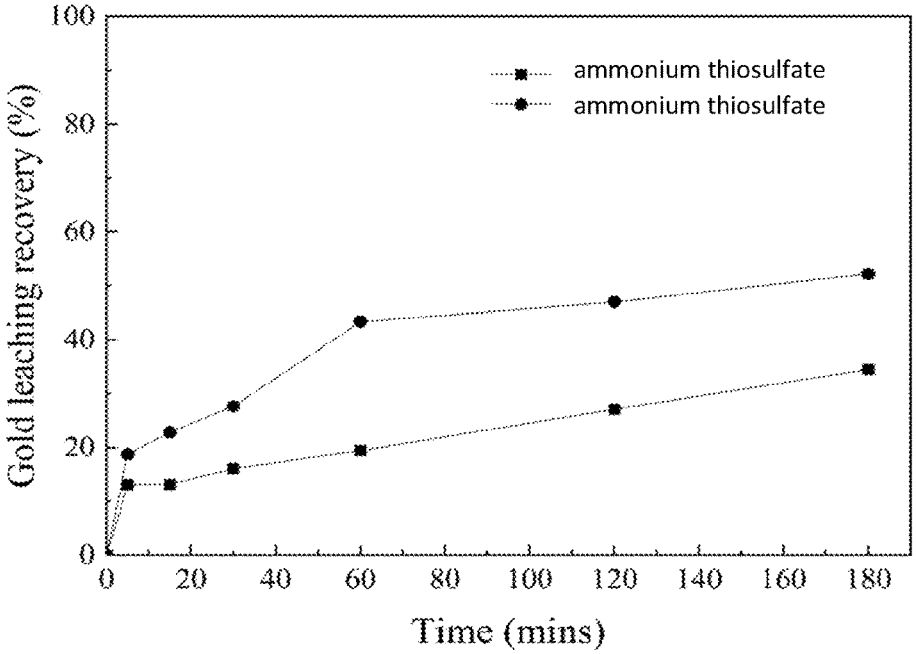
FIG. 23 shows leaching performance of gold using different concentrations of ammonium thiosulfate.
Figure 24:
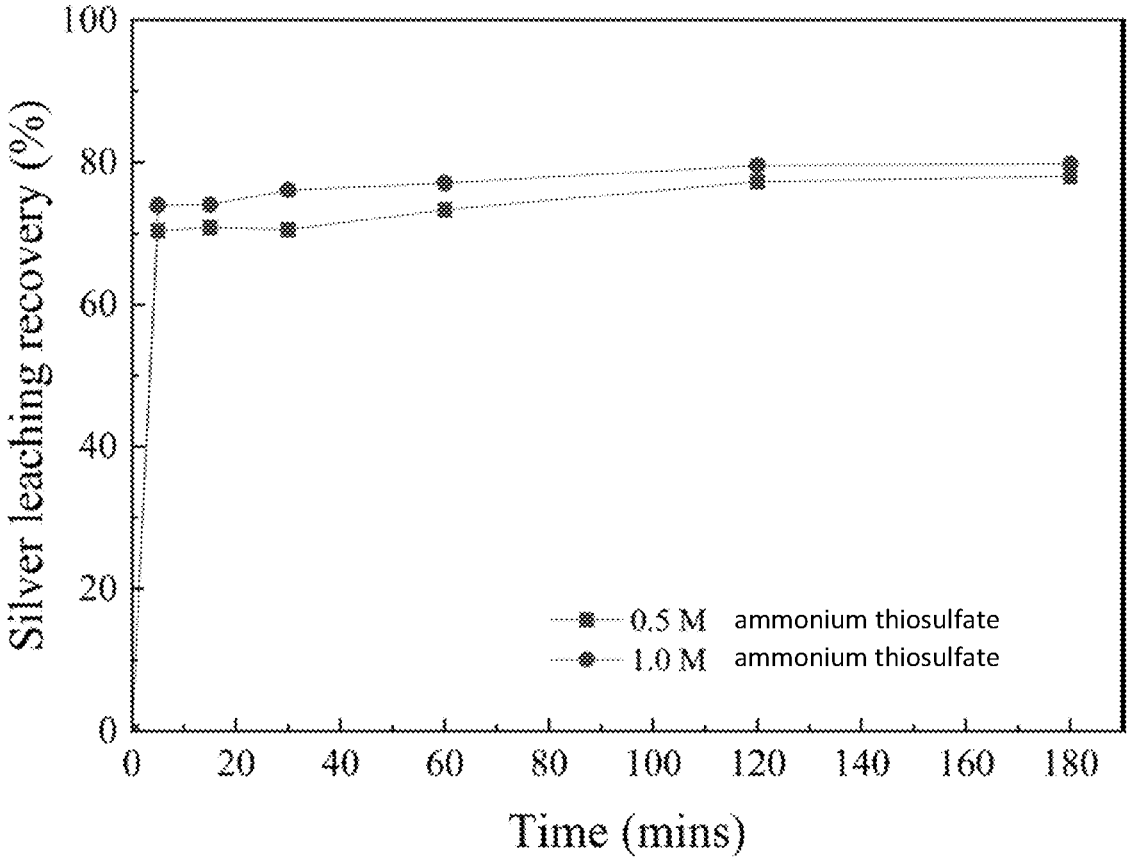
FIG. 24 shows leaching performance of silver using different concentrations of ammonium thiosulfate.

The leaching experiments were performed at 40° C. with an agitation of 500 rpm for 3 hours. The solid/liquid ratio value was 0.01 g/ml. The leaching solution was prepared by dissolving ammonium thiosulfate into deionized water, along with 0.05 M $Cu(NO_3)_2$. Two concentrations (i.e., 0.5 M, 1.0 M) of ammonium thiosulfate solutions were prepared separately. The results shown in FIGS. 23 and 24 indicated that, the leaching reaction proceeded rapidly in the first few minutes, after which the leaching recovery of gold and silver increased slowly with leaching time. An appropriate increase of ammonium thiosulfate concentration can increase the leaching recovery of gold and silver accordingly. Overall, ammonium thiosulfate leached silver better than gold. After three hours of leaching, the recovery of gold was only about 50% at the highest. Therefore, in order to improve the gold recovery, further adjustments of the test parameters, such as increasing the concentration of ammonium thiosulfate and copper ions, or extending the leaching time, were required. However, the most critical point was that using ammonium thiosulfate as the leaching agent inevitably introduced additional copper ions into the leach solution, which was contrary to the purpose of leaching at the very beginning and at the same time did not facilitate the downstream solvent extraction step.

Figure 25:
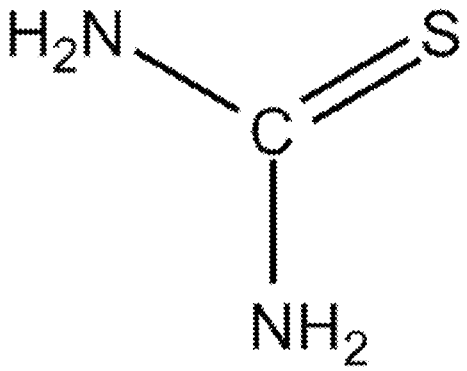
FIG. 25 shows the molecular structure of thiourea.

Second Stage Leaching—Thiourea: The third leaching agent investigated was thiourea, whose molecular structure is shown in FIG. 25. Like thiosulfate, thiourea is a less environmentally hazardous leaching agent for gold. Thiourea has many characteristics. It is unstable in alkaline solutions and can be easily decomposed by oxidation, so an acidic medium should be used to prepare leaching solutions. Ferric ions have been used as an oxidizing agent to improve the leaching recovery of gold, and it is reported that the leaching efficiency of gold can be increased by four times when ferric ions is added than when ferric ions is not added. Thiourea is not thermally stable and tends to decompose when heated, so the leaching reaction is best carried out at room temperature.

Reactions involved in the thiourea/ferric ions leaching system of gold are shown in Equation 11 to Equation 14:

$$Au + 2SC(NH_2)_2 + Fe^{3+} = Au[SC(NH_2)_2]_2^+ + Fe^{2+} \quad \text{Equation 11}$$

$$2CS(NH_2)_2 + 2Fe^{3+} \rightarrow (SCN_2H_3)_2 + 2Fe^{2+} + 2H^+ \quad \text{Equation 12}$$

$$(SCN_2H_3)_2 \rightarrow CS(NH_2)_2 + NH_2CN + S \quad \text{Equation 13}$$

Ferric ions was used as an oxidizing agent, while thiourea dissolved gold by forming cationic complexes ($Au(SC[NH_2]_2)_2^+$). However, it is worth noting that high concentrations of ferric ions can also oxidize thiourea to form formamidine disulfide, which is an unstable product in acidic solution that quickly decomposes into elemental sulfur and cyanamide. Meanwhile, sulfur will cause passivation on the surface of gold, hindering the dissolution of the gold.

$$Fe^{3+} + SO_4^{2-} + CS(NH_2)_2 \rightarrow [FeSO_4 \cdot CS(NH_2)_2]^+ \quad \text{Equation 14}$$

In addition, ferric ions can also be complexed directly with thiourea to form a stable ferric sulfate product, which consumes thiourea and reduces the leaching efficiency.

Figure 26:
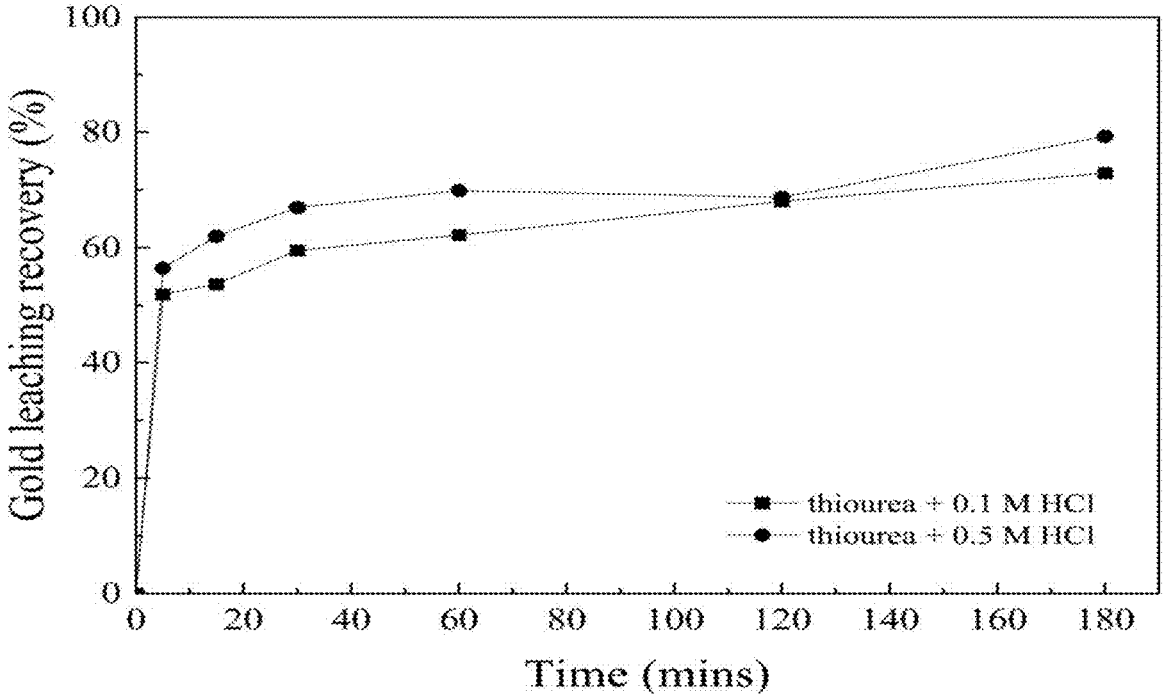
FIG. 26 shows leaching performance of gold using thiourea with different concentrations of hydrochloric acid.
Figure 27:
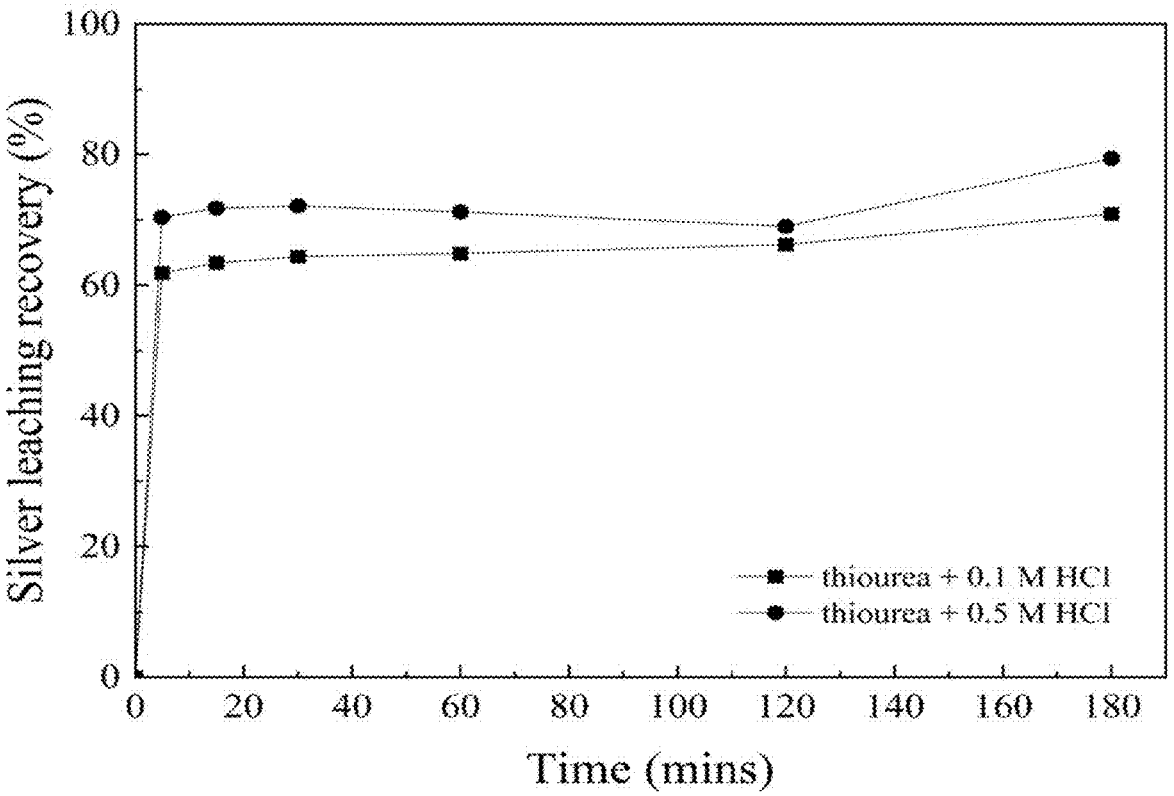
FIG. 27 shows leaching performance of silver using thiourea with different concentrations of hydrochloric acid.

The leaching experiments were performed at room temperature (~23° C.) with an agitation of 600 rpm for 3 hours. The solid/liquid ratio value was 0.02 g/ml. The leaching solution was prepared by dissolving 1.5 g thiourea into 50 ml hydrochloric acid along with 0.6% $[Fe_2(SO_4)_3]$. Two hydrochloric acid concentrations (i.e., 0.1 M and 0.5 M) were prepared separately. The results shown in FIGS. 26 and 27 indicate that, the leaching reaction proceeded rapidly in the first few minutes, after which the leaching recovery of gold and silver increased slowly with leaching time. Meanwhile, increasing the concentration of hydrochloric acid in the leaching solution was beneficial to improve the leaching efficiency of gold and silver. With the increase of leaching time, the leaching recovery of gold and silver were close to each other. After three hours of leaching, the maximum recovery of gold was about 80%. Therefore, in order to further improve the gold recovery, adjustments of test parameters, such as increasing the acid and thiourea concentrations and extending the leaching time, were needed. At the same time, it should not be overlooked that, as an oxidizer, the introduced iron ions can significantly increase the iron content in the leachate, which was detrimental to the subsequent solvent extraction. Especially when the extractant is D2EHPA, the high concentration of iron ions will make the third phase appear in the solvent extraction process, thus greatly reducing the extraction efficiency.

To solve these problems, different oxidants were tried to replace ferric ions. Firstly, hydrogen peroxide was used because it did not introduce new metal impurities into the leach solution. However, preliminary experimental results showed a very low recovery of gold, less than 20%. This is due to the fact that hydrogen peroxide is a strong oxidizing agent that can easily decompose thiourea. Therefore, another milder oxidizing agent needs to be used. It was reported that oxygen in air could also be used as an oxidizing agent for thiourea leaching, and the reaction is shown in Equation 15:

$$Au+2SC(NH_2)_2+\tfrac{1}{4}O_2+H^+=Au[SC(NH_2)_2]_2+\tfrac{1}{2}H_2O \quad \text{Equation}$$

Figure 28:
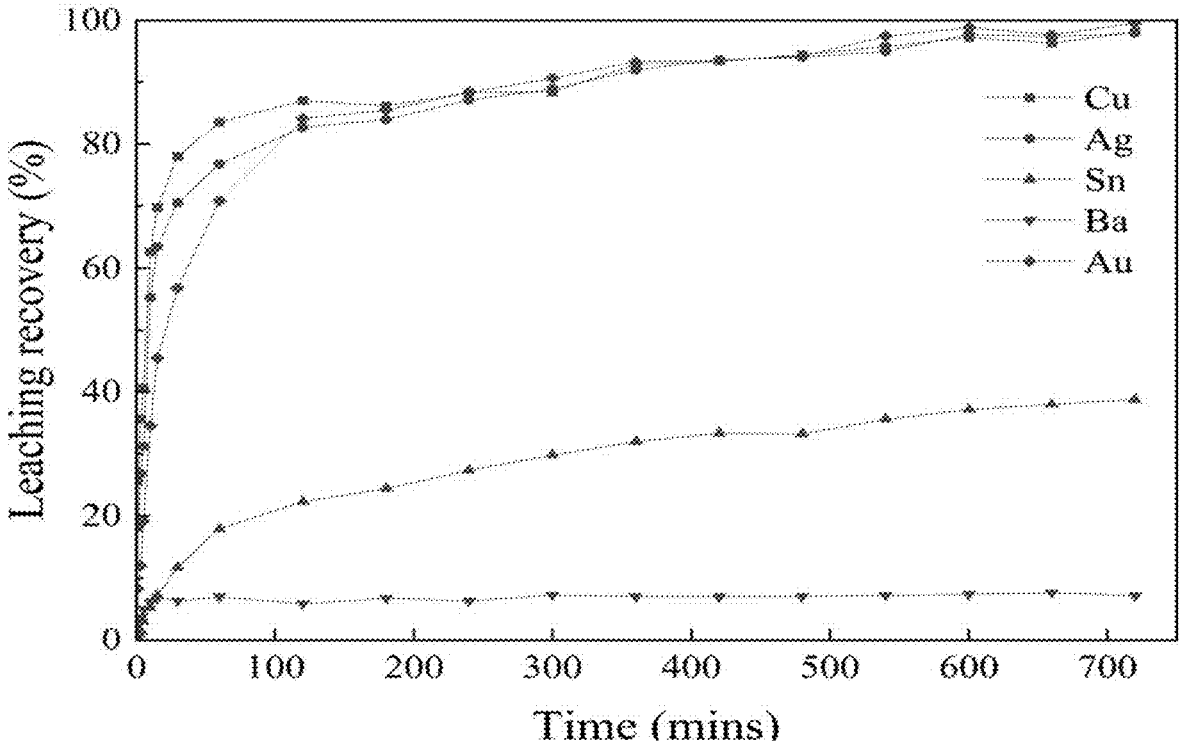
FIG. 28 shows leaching kinetics in the second leaching stage (0.03 g/ml thiourea dissolved in 0.5 M HCl, 0.02 g/ml solid/liquid ratio, room temperature).

Leaching kinetic results of using oxygen in the air instead of ferric ions as the oxidizer is shown in FIG. 28, which indicated that, the leaching recoveries of gold, silver, and copper increased rapidly during the first hour and then slowly with time thereafter. After about 10 hours of leaching, the gold recovery was close to 100%, meanwhile, the recoveries of silver and copper were close to 100%. Around 8% of barium and 38% of tin were also leached out. In summary, when oxygen in the air was used as the oxidizing agent, all the gold could be dissolved in the solution after 10 hours of leaching. At this point, the two-step leaching was completed. The leachate collected after the second leaching was considered as the PLS for the next solvent extraction step. The elemental concentration of the PLS is shown in Table 2.

Solvent Extraction with Bulk Mixer-Settlers: As Table 2 shows, the concentration of Au in the second stage leaching solution is relatively high and close to that of Cu (50.99 mg/L versus 65.93 mg/L). Therefore, solvent extraction with bulk mixer-settlers was conducted to extract and purify Au. TBP was first used as an extractant for the solvent extraction test, however, a large amount of brown third phase appeared during the experiments, so for the PLS generated in this study, TBP was not applicable to be used as an extractant. D2EHPA was then used as an extractant, which is a typical acidic extractant whose extraction principle is cation exchange (shown in Equation 16):

$$[Au(CS(NH_2)_2)_2^+]_{aq} + 3[R_2H_2]_{org} = [Au(CS(NH_2)_2)_2R\cdot 5RH]_{org} + [H^+]_{aq} \quad \text{Equation 16}$$

Where $R_2H_2$ is a dimeric form of D2EHPA, the gold-thiourea complex ions are solvated with 5 molecules of D2EHPA monomer.

Figure 29:
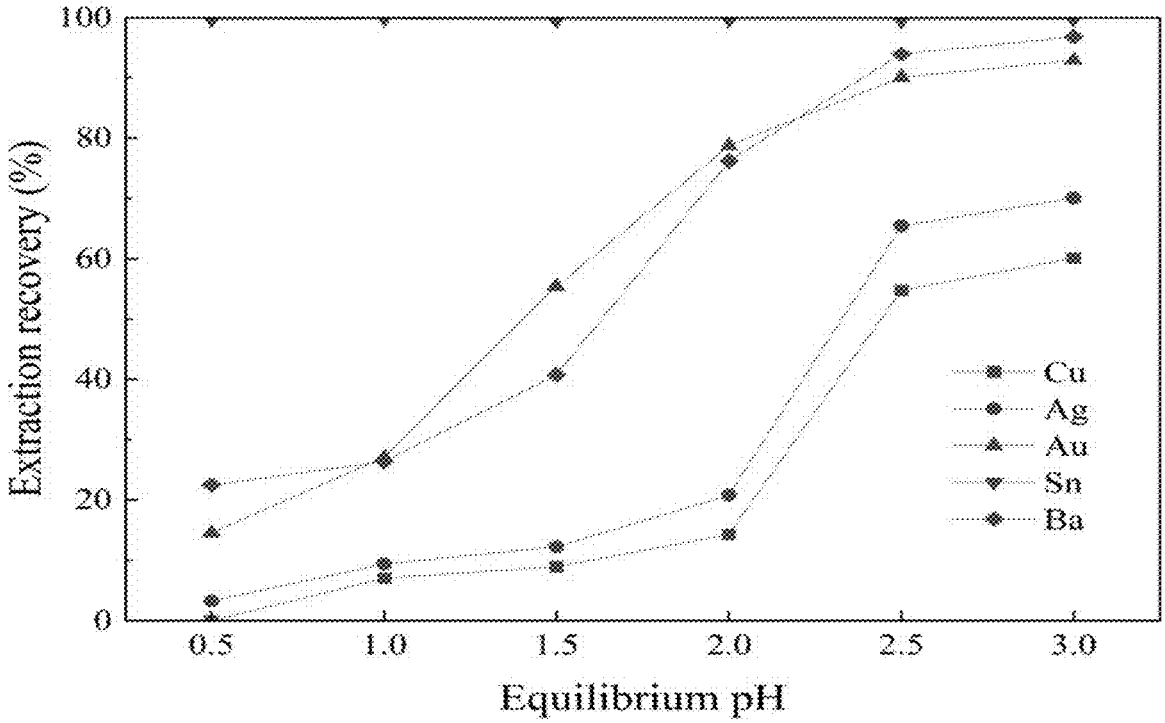
FIG. 29 shows effects of equilibrium pH on the solvent extraction performance.
Figure 30:
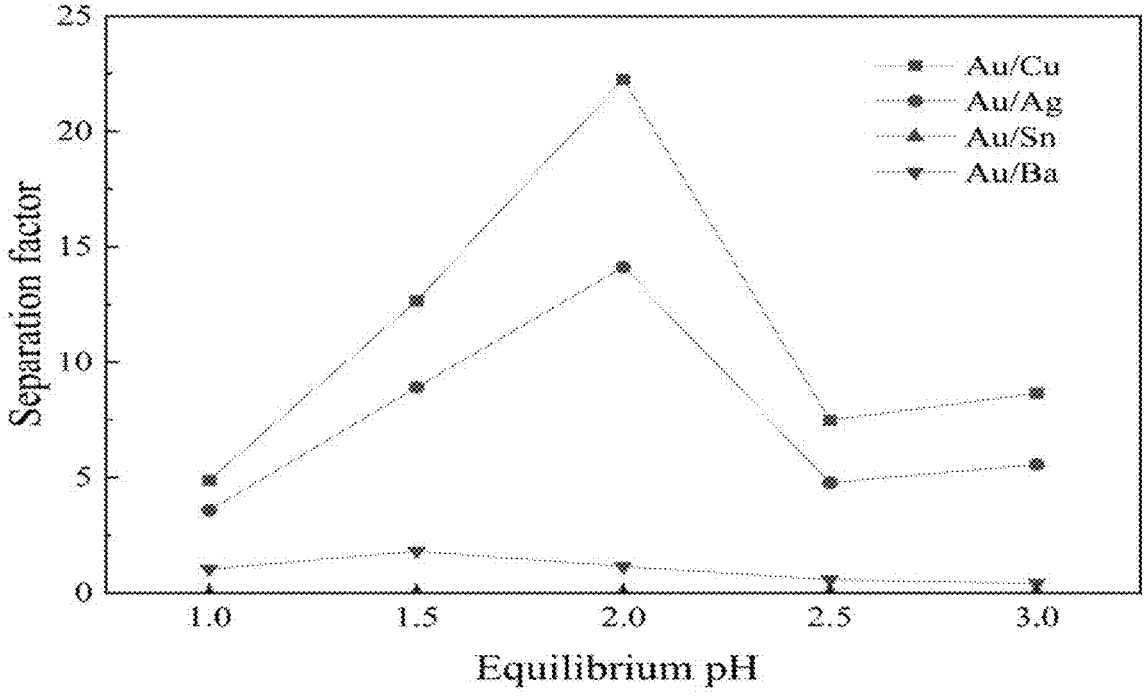
FIG. 30 shows separation factors at different equilibrium pH values.
Figure 31:
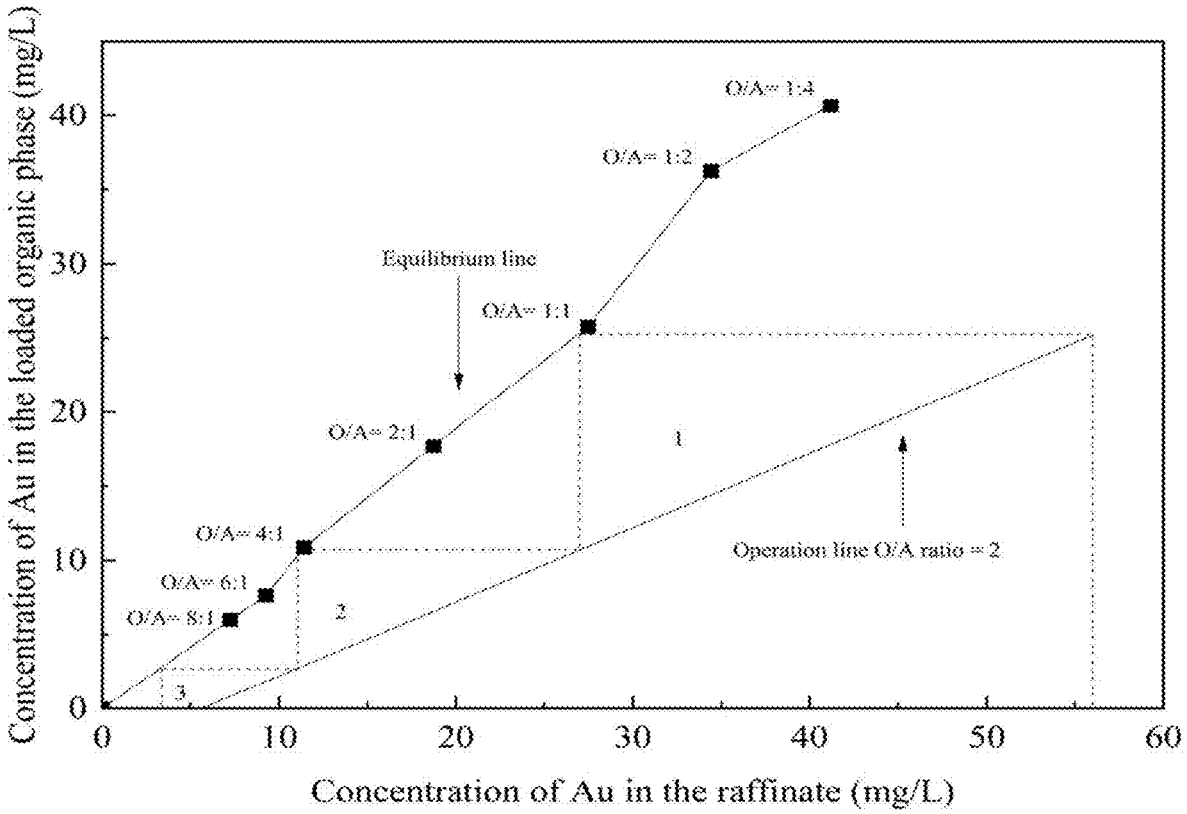
FIG. 31 shows McCabe-Thiele extraction diagram (equilibrium pH=2).

The extraction experiments mainly investigated the effect of the equilibrium pH of the aqueous phase on the extraction recovery of gold. As shown in FIG. 29, the extraction efficiency of metals increased with the increase of the equilibrium pH. The extraction efficiency of silver and copper increased rapidly when the equilibrium pH was higher than 2. Meanwhile, according to the separation factor shown in FIG. 30, aluminum and barium tended to be extracted along with gold, but for copper and silver, when the equilibrium pH value was 2, the separation factor was as high as 22 and 14, separately. Therefore, to separate the gold from other base metals, a suitable equilibrium pH value of around 2 was selected. Moreover, the solvent extraction recovery of gold at pH 2 was around 80%. Therefore, to achieve above 90% recovery, multiple solvent extraction steps were required. FIG. 31 shows the McCabe-Thiele extraction diagram, which indicates that three solvent extraction steps are needed to achieve over 90% recovery of gold, when the O/A ratio was 2. The elemental composition in the loaded organic phase is shown in Table 2.

Figure 32:
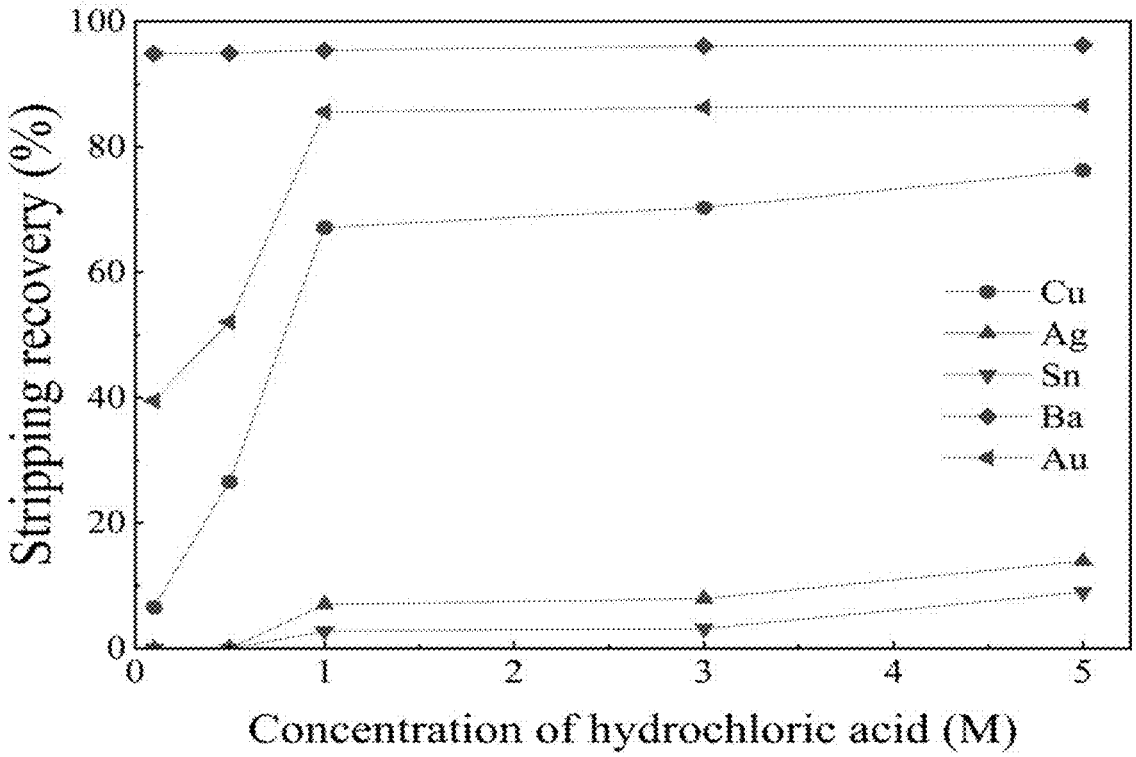
FIG. 32 shows stripping performance using various concentrations of HCl solutions.

The gold in the loaded organic phase needs to be stripped back into the aqueous solution for subsequent precipitation treatment. Therefore, a hydrochloric acid solution containing thiourea was used as the fresh stripping solution. The effect of hydrochloric acid concentration on metal stripping efficiency was investigated. As shown in FIG. 32, when the concentration of hydrochloric acid was lower than 1.0 M, increasing the concentration of acid was beneficial to improve the stripping efficiency of most metals. However, when the concentration of acid was greater than 1.0 M, increasing the concentration of hydrochloric acid had little improvement in the stripping efficiency. Meanwhile, barium was easily stripped out, regardless of the concentration of the hydrochloric acid. The highest stripping recovery of gold was 88%. Multiple stripping steps can further increase gold recovery. The elemental concentration in the final aqueous solution is shown in Table 2.

Figure 33:
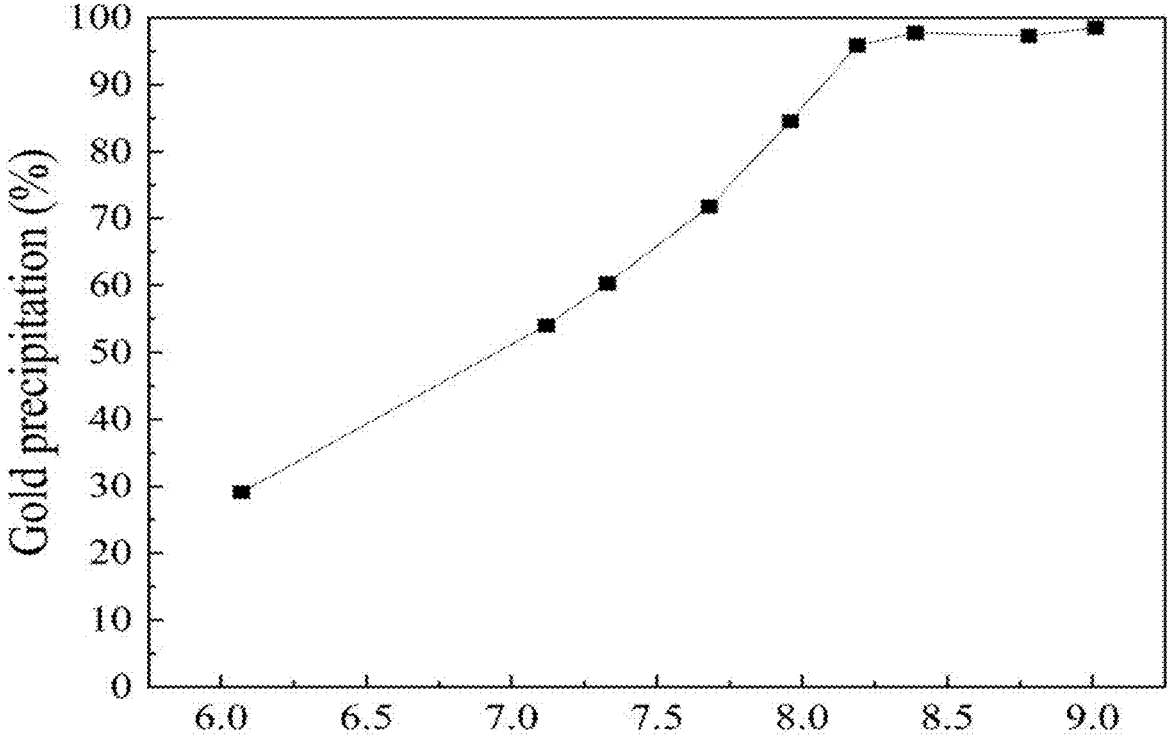
FIG. 33 shows precipitation of gold using sodium borohydride at different equilibrium pH values.

Sodium borohydride has been proven to be an effective gold precipitant. In order to generate high-purity gold products from the purified gold aqueous solutions, the precipitation by reduction method was applied. The experiments mainly investigated the relationship between the solution's final pH value and the precipitation efficiency of gold. The results shown in FIG. 33 indicate that, as the pH value increased, the precipitation efficiency of gold also increased, and when the pH was higher than 8.5, almost all the gold in the solution was precipitated. The elemental composition in the final precipitates is shown in Table 3, indicating the precipitates contain around 88 wt. % of gold, 8 wt. % of barium, 1.8 wt. % of tin, and 1.5 wt. % of silver.

TABLE 3

The weight percentage of metals in the precipitates (balanced).

| Element | % | Element | % |
|---|---|---|---|
| Au | 88.2 | Ba | 8.0 |
| Ag | 1.5 | Al | 0.0 |
| Pd | 0.3 | Ti | 0.0 |
| Pt | 0.0 | Fe | 0.0 |
| Cu | 0.0 | Ni | 0.2 |
| Sn | 1.8 | | |

Figure 34:
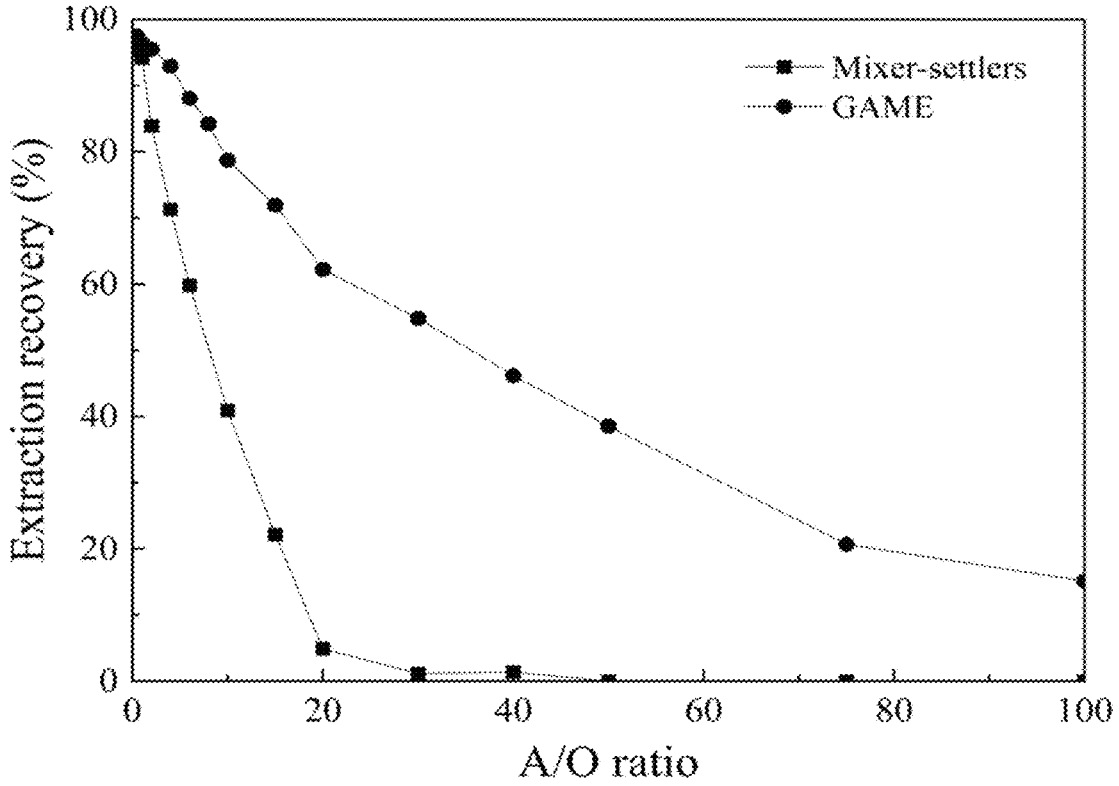
FIG. 34 the extraction performance of using the GAME system and conventional mixer-settlers at various A/O ratios separately.

Gas-Assisted Microbubble Extraction: The kinetics of solvent extraction is a function of both kinetics of the various chemical reactions that occur in the system and the diffusion rate of the various species that control the chemistry. Mechanical stirring is normally applied in bulk solvent extraction with mixer-settlers to make sure that the aqueous and organic phases are well-mixed. However, as FIG. 34 shows, no matter how strong the stirring, two stagnant thin films always exist at the aqueous-organic interface, which can only be crossed by diffusion processes. The amount of solute passing perpendicularly through a unit area of the films during a unit time can be measured using diffusion flux J ($g/cm^2/s$), which is expressed through Fick's first law:

$$J = -D\frac{\partial C}{\partial h}$$

where C and h represent the bulk concentration of the solute and thickness of the films, respectively, and D is the diffusion coefficient. Extraction kinetics can be improved by multiple means, such as decreasing film thickness and increasing interfacial area. However, the size of the interface area that can be generated through mechanical stirring is limited, since excessive stirring will lead to the formation of emulsions, which are difficult to coalesce, and can cause problems in phase disengagement. Moreover, as in the equation, the diffusion rate will be exceedingly small when the concentration of target metals in aqueous phase is low;

thus, solvent extraction with conventional mixer-settlers is not suitable for processing solutions with valuable species of low concentrations.

Micro-flow extraction (ME) has been extensively tested in the laboratory as an efficient method to recover and purify high-value metals such as platinum, palladium, and rare earth elements. ME occurs in well-defined channels in the range of a few hundred microns, which brings remarkably high mass transfer rates due to the large interfacial area and short mass transfer diffusion distance. The volumetric mass transfer coefficients of microflow extractors are several orders of magnitude larger than those of the conventional extractors. Therefore, high extraction recoveries can be achieved during a short residence time. Moreover, high volumetric throughputs can be achieved by "numbering-up;" i.e., using numerous reactors in parallel to maintain optimal physical and chemical conditions. A liquid-liquid two-phase microflow is most commonly found in a ME system, which can be easily achieved in micro-structured components, such as microchannels and microtubes.

For extracting low-concentration metals, a high aqueous to organic phase volumetric (A/O) ratio has to be used, which enables the organic phase to reach critical saturation values in a shorter time period. In this case, the acids and other chemicals consumed in the scrubbing and stripping stages can be significantly reduced, thus promoting economic viability for metal recovery from low-concentration leach solutions. As previously mentioned, this two-phase ME has numerous advantages over bulk solvent extraction with mixer-settlers, such as a high mass transfer rate and low residence time. Benefiting from the enhanced mass transfer caused by chaotic advections, plug flow and bubbly flow extractors can operate properly under relatively high A/O ratios. However, once the structure and dimension of microchannels are fixed, the length between two adjacent plugs increased with the increase in the A/O ratio, which led to a longer mass diffusion distance and lower extraction efficiency (see FIGS. 1 and 2). This indicates that liquid-liquid two-phase microflow extractors cannot efficiently extract low-concentration metals from aqueous solutions where extremely high A/O ratios must be used.

Figure 2:
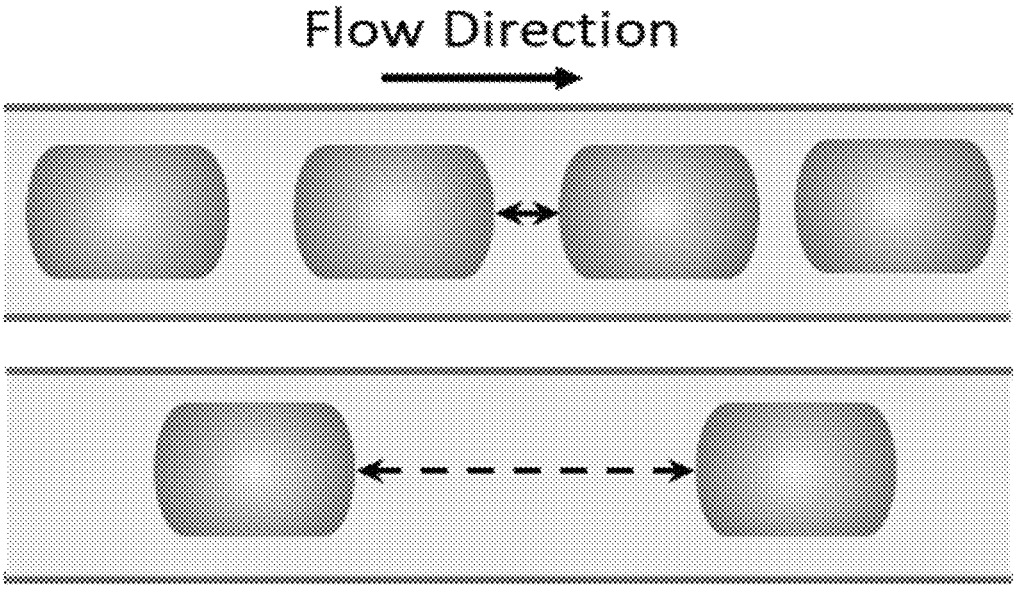
FIG. 2 shows schematic of the increased distance between two adjacent plugs in microchannels.

To shorten the mass transfer distance while keeping a large A/O ratio, a potential solution lies in introducing a third phase (gas) into the system, which converts the dispersed organic phase from solid into hollow droplets. As FIG. 2 shows, in a confined space, the organic phase is more dispersed when occurring as hollow droplets. Therefore, the mass transfer rate and extraction efficiency are considerably improved. Per this concept, gas-assisted microbubble extraction (GAME) systems can be used to handle extremely high A/O situations. Moreover, the introduction of a third phase increases the degree of mixing, which further improves mass transfer rates. Therefore, efficient separation can be achieved through GAME.

GAME can occur in microchannels like ME; however, the throughout capacity is low due to the small diameter of microchannels. A novel reactor that enables GAME at high throughput capacities was designed by the inventors. As FIGS. 4, 5, and 7 shows, the reactor consists of three compartments that are separated by two porous media (e.g., glass frits). A gas phase (e.g., nitrogen) is introduced into the bottom compartment and goes into the second compartment where the organic phase is introduced. When the gas passes the bottom porous media, bubbles are formed in the middle compartment. Under the function of positive pressure, both the organic and gaseous phases go into the top compartment, where the aqueous phase is introduced. Under the function of the top porous media, bubbles coated with the organic phase are formed and finely dispersed in the aqueous phase. Therefore, the mass transfer distance between the aqueous and organic phases is reduced, and the reactor is suitable for handling exceedingly high A/O ratio situations. In other words, solvent extraction with the GAME extractor can extract low-concentration species from complex aqueous streams.

Figure 35:
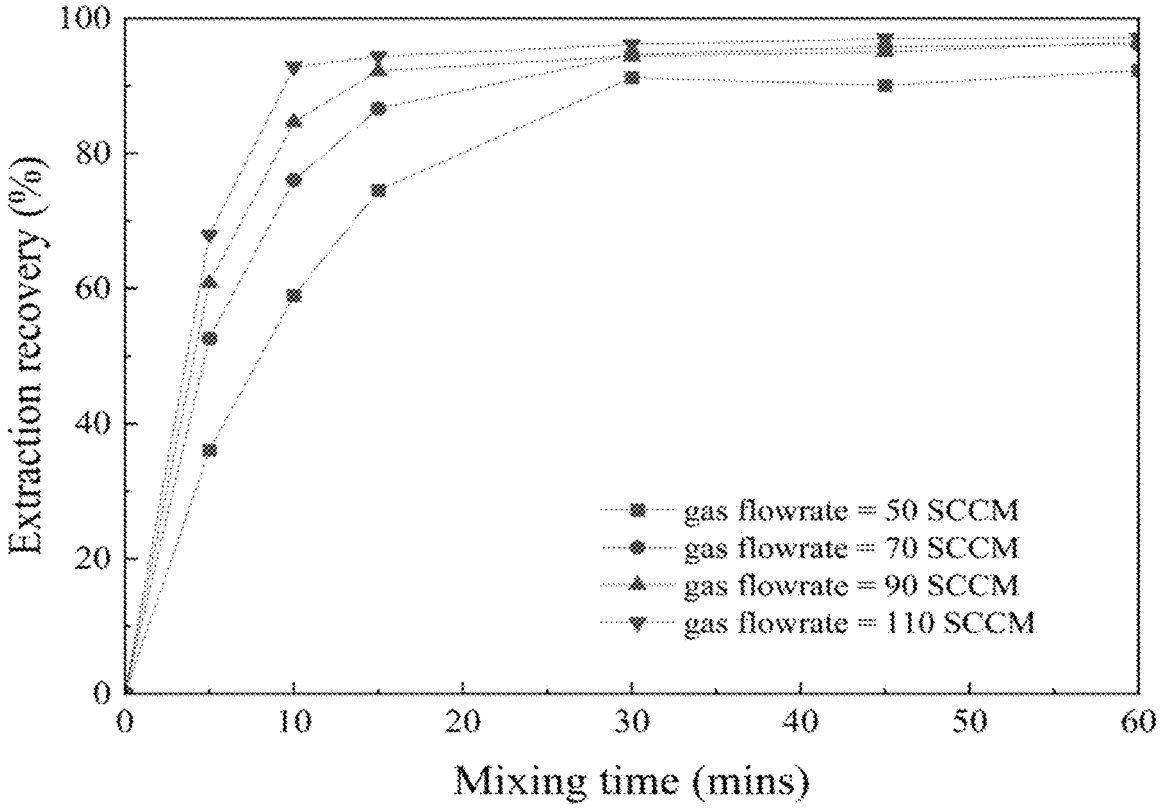
FIG. 35 shows extraction performance using the GAME reactor and a conventional mixer-settler.

FIG. 34 compares the extraction recovery of Nd from a solution (10 ppm) using the GAME reactor and a conventional mixer-settler at different A/O ratios. As the ratio increased, the recovery was decreased for both, but the GAME reactor gave higher recoveries than the conventional mixer-settler. In addition, >90% recovery values were still obtained at an A/O ratio of 50 by adjusting gas flowrate and mixing time (FIG. 35). Therefore, replacing conventional mixer-settlers with GAME reactors enables the extraction of low-concentration species from complex aqueous streams through solvent extraction.

While particular aspects have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

It is appreciated that all reagents are obtainable by sources known in the art unless otherwise specified.

It is also to be understood that this disclosure is not limited to the specific aspects and methods described herein, as specific components and/or conditions may, of course, vary. Furthermore, the terminology used herein is used only for the purpose of describing particular aspects of the present disclosure and is not intended to be limiting in any way. It will be also understood that, although the terms "first," "second," "third" etc. may be used herein to describe various elements, components, regions, layers, and/or sections, these elements, components, regions, layers, and/or sections should not be limited by these terms. These terms are only used to distinguish one element, component, region, layer, or section from another element, component, region, layer, or section. Thus, "a first element," "component," "region," "layer," or "section" discussed below could be termed a second (or other) element, component, region, layer, or section without departing from the teachings herein. Similarly, as used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof. The term "or a combination thereof" means a combination including at least one of the foregoing elements.

Unless otherwise defined, all terms (including technical and scientific terms) used herein have the same meaning as commonly understood by one of ordinary skill in the art to which this disclosure belongs. It will be further understood that terms such as those defined in commonly used dictionaries, should be interpreted as having a meaning that is consistent with their meaning in the context of the relevant art and the present disclosure, and will not be interpreted in an idealized or overly formal sense unless expressly so defined herein.

Reference is made in detail to exemplary compositions, aspects and methods of the present disclosure, which constitute the best modes of practicing the disclosure presently known to the inventors. The Figures are not necessarily to scale. However, it is to be understood that the disclosed aspects are merely exemplary of the disclosure that may be embodied in various and alternative forms. Therefore, specific details disclosed herein are not to be interpreted as limiting, but merely as a representative basis for any aspect of the disclosure and/or as a representative basis for teaching one skilled in the art to variously employ the present disclosure.

Patents, publications, and applications mentioned in the specification are indicative of the levels of those skilled in the art to which the disclosure pertains. These patents, publications, and applications are incorporated herein by reference to the same extent as if each individual patent, publication, or application was specifically and individually incorporated herein by reference.

The foregoing description is illustrative of particular embodiments of the disclosure, but is not meant to be a limitation upon the practice thereof. The following claims, including all equivalents thereof, are intended to define the scope of the disclosure.

The invention claimed is:

1. A process for extracting a metal comprising:

providing a metal solution to a three segment vertical reactor comprising a bottom segment for gas, a middle segment for an organic phase feed and an upper segment for an aqueous phase feed and an upper exit port, wherein the organic phase comprises one or more organic extractants and the aqueous phase comprises the metal solution and wherein a first porous material separates the bottom segment and the middle segment and a second porous material separates the middle segment and the upper segment;

introducing a gas to the reactor in the bottom segment, wherein the first porous material causes the gas to form bubbles in the organic phase and further wherein gas bubbles, organic droplets and organic phase-coated bubbles enter the aqueous phase to absorb one or more metals therein;

collecting a mixed phase from the upper exit port comprised of the gas, organic phase and aqueous phase;

separating the mixed phase into an organic fraction and an aqueous fraction; and, isolating one or more metals from the organic fraction.

2. The process of claim 1, wherein the aqueous phase to organic phase volumetric ratio therein is at least 20.

3. The process of claim 1, wherein the gas is selected from compressed air, carbon dioxide, nitrogen, oxygen, argon, helium, neon, krypton, and xenon.

4. The process of claim 1, wherein the first porous material and the second porous material both comprise pores of 1 to 100 μm.

5. The process of claim 1, wherein the first porous material and the second porous material are independently selected from a ultra high molecular weight polyethylene (UHMWPE), high density polyethylene (HDPE), polypropylene (PP), polytetrafluoroethylene (PTFE), polyvinylidene fluoride (PVDF), ethylene vinyl acetate (EVA), polyether sulfone (PES), polyurethane (PU), a metal, a metal oxide, stainless steel, copper, aluminum, zirconiua, silica, quarts, a ceramic, or glass.

6. The process of claim 1, wherein the organic extractant is selected from a neutral extractant compound with a C—O, P—O, S—O, and/or P—S bond, an acidic extractant compound that contains a —COOH, —P(O)OH, and/or —$SO_3H$ group, and an alkaline extractant compound that contains an amine or quaternary ammonium group.

7. The process of claim 6, wherein the organic extractant comprises Di(2-ethylhexyl)phosphoric acid (D2EHPA).

8. The process of claim 1, further comprising preparing the aqueous phase by contacting a metal source with a leachant and collecting a leached metal solution therefrom as the aqueous phase.

9. The process of claim 8, wherein the leachant is selected from a mineral acid, an inorganic acid, a salt, an oxidizing agent, a reducing agent, a complexing agent, and a base.

10. The process of claim 8, wherein the leachant comprises a complexing agent and an oxidizing agent.

11. The process of claim 8, further comprising a further leaching stage comprising dissolving base metals with a mineral acid or a mineral acid and an oxidizing agent to form a solution.

12. The process of claim 11, wherein the mineral acid is hydrochloric acid and hydrogen peroxide.

13. The process of claim 11, wherein the solution from the further leaching stage is also fed to the reactor as at least part of the aqueous phase.

14. The process of claim 1, wherein the organic phase and aqueous phase are independently pumped into the reactor at a rate of between 1 mL/min to 100 L/min.

15. The process of claim 1, wherein the gas is introduced at a rate of from 1 mL/min to 100 L/min.

16. The process of claim 1, further comprising combustion of a composition comprising a base metal, a precious metal, and/or a rare earth metal to obtain an ash and contacting the ash with a leachant and then providing the leachant to the reactor as at least part of the aqueous phase.

17. The process of claim 1, wherein the metal solution comprises one or more of gold, silver, platinum, palladium, ruthenium, rhodium, iridium, osmium, yttrium, scandium, lanthanum, cerium, praseodymium, neodymium, promethium, samarium, europium, gadolinium, terbium, dysprosium, holmium, erbium, thulium, ytterbium, lutetium, copper, nickel, tin, aluminum, zinc, tin, lead, iron, titanium, uranium, thorium, polonium, radium, neptunium, lithium, nickel, cobalt, manganese, magnesium, vanadium, and chromium.

* * * * *